US008584742B2

(12) United States Patent
Usui et al.

(10) Patent No.: US 8,584,742 B2
(45) Date of Patent: Nov. 19, 2013

(54) HEAT EXCHANGER

(75) Inventors: Masayoshi Usui, Numazu (JP); Yasuaki Hashimoto, Izu (JP); Koichi Hayashi, Mishima (JP); Shigeyuki Ishida, Mishima (JP); Tetsuo Ogata, Ann Arbor, MI (US); Nagahisa Amano, Mishima (JP); Koji Kurita, Shizuoka (JP); Shu Yotsumoto, Shizuoka (JP)

(73) Assignee: Usui Kokusai Sangyo Kaisha, Ltd., Shizuoka (JP)

( * ) Notice: Subject to any disclaimer, the term of this patent is extended or adjusted under 35 U.S.C. 154(b) by 1391 days.

(21) Appl. No.: 10/574,041

(22) PCT Filed: Dec. 10, 2004

(86) PCT No.: PCT/JP2004/018461

§ 371 (c)(1),
(2), (4) Date: Jun. 15, 2006

(87) PCT Pub. No.: WO2005/057120

PCT Pub. Date: Jun. 23, 2005

(65) Prior Publication Data

US 2007/0062677 A1 Mar. 22, 2007

(30) Foreign Application Priority Data

Dec. 15, 2003 (JP) ..... 2003-417320
Jun. 3, 2004 (JP) ..... 2004-165665

(51) Int. Cl.
*F28D 1/00* (2006.01)
*F28D 1/04* (2006.01)

(52) U.S. Cl.
USPC ..... 165/150; 165/151

(58) Field of Classification Search
CPC ..... F28F 1/006
USPC ..... 165/150, 151, 152, 76, 182; 29/890.047; 72/299
See application file for complete search history.

(56) References Cited

U.S. PATENT DOCUMENTS 1,773,249 A * 8/1930 Yeager ..... 165/151
2,475,187 A * 7/1949 Kramer ..... 29/890.046

(Continued)

FOREIGN PATENT DOCUMENTS

JP 54-88867 7/1979
JP 59-153532 9/1984

(Continued)

*Primary Examiner* — Tho V Duong
(74) *Attorney, Agent, or Firm* — Jordan and Hamburg LLP

(57) ABSTRACT

A heat exchanger having excellent heat exchanging performance is obtainable by a simple production technique and at a low cost. This is achieved by providing a fin member and by increasing heat conductivity between the fin member and a meandering pipe body. Further, the heat exchanger is made compact for high degrees of layout freedom, enabling the heat exchanger to be installed in a tight space. Engagement grooves (8) are provided in both end surfaces (6, 7), which are opposite to each other, of a fin member (5) in which fins (4) are parallel arranged. Straight pipe sections (2) are parallelly arranged, with gaps (16)in between, in the engagement grooves (8) of the fin member (5). The straight pipe sections (2)*a* are connected at bent sections (3). A pair of meandering sections (11, 12) is arranged opposite to each other with an insertion gap (17) of the fin member (5) in between. On (11) of the meandering sections and the other meandering section (12) are connected by a connection pipe (13) to form a meandering pipe main body (1). The straight pipe sections (2) of the one meandering section (11) are arranged in the engagement grooves (8) in the one end surface (6) of the fin member (5) inserted and arranged in the insertion gap (17) between the one meandering section (11) and the other meandering section (12) of the meandering pipe body (1), and the straight pipe sections (2) of the other meandering section (12) are arranged and fixed in the engagement grooves (8) in the other end surface (7).

21 Claims, 28 Drawing Sheets

(56) References Cited

U.S. PATENT DOCUMENTS

| | | | | | |
|---|---|---|---|---|---|
| 2,851,082 | A | * | 9/1958 | Charlton | 72/299 |
| 2,908,070 | A | * | 10/1959 | Thomas et al. | 29/890.047 |
| 2,998,639 | A | * | 9/1961 | Forst et al. | 29/890.046 |
| 3,106,958 | A | * | 10/1963 | Simpelaar | 165/181 |
| 3,780,799 | A | * | 12/1973 | Pasternak | 165/150 |
| 4,434,843 | A | * | 3/1984 | Alford | 165/150 |
| 4,881,311 | A | * | 11/1989 | Paulman et al. | 29/890.047 |
| 2005/0092473 | A1 | * | 5/2005 | Smithey et al. | 165/151 |

FOREIGN PATENT DOCUMENTS

| | | |
|---|---|---|
| JP | 63-190777 | 12/1988 |
| JP | 6-101982 | 4/1994 |
| JP | 9-42573 | 2/1997 |
| JP | 9-42877 | 2/1997 |
| JP | 9-145282 | 6/1997 |
| JP | 9-280769 | 10/1997 |
| JP | 2001-056191 | 2/2001 |
| JP | 2001-200765 | 7/2001 |
| JP | 2002-64170 | 2/2002 |
| JP | 2002-071295 | 3/2002 |
| JP | 2002-139282 | 5/2002 |
| JP | 2002-257482 | 9/2002 |
| JP | 2002-364476 | 12/2002 |
| JP | 2003-88924 | 3/2003 |
| JP | 2003-214791 | 7/2003 |

* cited by examiner

HEAT EXCHANGER

BACKGROUND OF THE INVENTION

1. Field of the Invention

The present invention relates to fluid cooling pipes for the use of fuel pipes, oil pipes and the like, EGR gas cooling apparatuses, air-conditions for adjusting temperature and humidity of room spaces, and other heat exchangers for vehicles or general industrial applications. Purpose of the present invention is to obtain a heat exchanger excellent in heat exchanging ability with a simple manufacturing technique and process at low cost.

2. Description of Related Art

Conventionally, there has been existing fluid cooling pipes for the use of fuel pipes, oil pipes and the like, EGR gas cooling apparatuses, air-conditions for adjusting temperature and humidity of room spaces, and other heat exchangers for vehicles or for the sake of general industrial applications. For example, a fuel pipe for vehicles, as shown in Japanese Patent Laying-Open No. 2001-200765, is connected to a fuel cooler comprising a tank for storing cooling water, coolant for air-conditions for vehicles and other coolant fluid to cool down oil or the like that flows within the fuel pipe. However, in the use of diesel engines, since the fuel pipes are placed on an underfloor, placement of tanks or the like to the underfloor where there is only a narrow space involves difficulties, and therefore there is a difficulty in realizing cooling by coolant fluid. In this regard, such air-cooling type heat exchangers have been frequently used that cooling is done by exchanging heat with the external air, as disclosed in Japanese Patent Laying-Open Nos. 09-42573, 2002-364476, 2003-88924 and 2002-64170.

Japanese Patent Laying-Open Nos. 09-42573 and 2002-364476 disclose that metal-made band-like fin members are disposed spirally on an outer periphery of a pipe main body and plate-like fin members are disposed radially, respectively. Japanese Patent Laying-Open No. 2003-88924 discloses that a plurality of straight pipe sections are inserted into a plurality of metal-made, e.g. aluminium, thin fins, mandrels are press-inserted into the pipe main bodies and straight pipe sections are expanded in order to caulk the fin members on the outer periphery of straight pipe sections. Then, adjacent ends of straight pipe sections are joined through an U-bend pipe to lengthen the entire pipe body in order to improve heat exchange ability.

In the above Japanese Patent Laying-Open Nos. 09-42573, 2002-364476, 2003-88924 and 2002-64170, there is disclosed that heat from oil or the like flowing within the pipe main body is discharged to the external air through the fin member, thereby cooling the oil. A heat exchanger using thin plate fins as disclosed in Japanese Patent Laying-Open No. 2003-88924 is widely used not only for fuel pipes but also for radiators, indoor equipment for air-conditions.

Japanese Patent Laying-Open No. 2002-64170 discloses a heat sink for cooling semiconductors and the like used in electronic devices such as computers, in which a plurality of fins are projectingly formed thereon by aluminium die casting to enhance heat discharge ability of the heat sink. Such a heat exchanger has been existing that the outer periphery of the fuel pipes, the oil pipes and the like are provided with a plurality of projecting fins by the aluminium die casting.

SUMMARY OF THE INVENTION

In the pipe main body as disclosed in Japanese Patent Laying-Open Nos. 09-42573 and 2002-364476, however, due to the fin member arranged spirally and radially, bending into a small curvature radius is difficult and therefore the entire body tends to be bulky and furthermore it is difficult to place the body to the underfloor or to a back surface of an apparatus. In the invention as disclosed in Japanese Patent Laying-Open No. 2003-88924, there is a problem on strength of respective thin plate-like fins, which may invite easy deformation or breakage of thin plate-like fins upon formation of insertion openings and insertion of the pipe main bodies. Therefore, such task requires carefulness and is time consuming. Also, this method in which the pipe main bodies are inserted into the thin plate-like fins involves difficulty in bending and inserting a single pipe main body. Therefore, as described above, after a plurality of straight pipe sections are inserted, adjacent ends of straight pipe sections are joined with a U-bent pipe, in which the joint between each straight pipe section and the U-bent pipe is bonded by welding or brazing. However, due to the presence of the thin plate-like fins and their three-dimensional shapes, welding and brazing of those thin plate-like fins are not easy and a leakage test of the joint is difficult to run. The fin member molded by aluminium die casting as disclosed in Japanese Patent Laying-Open No. 2002-64170 will result in being thick, so that there is a limit in lightening and down sizing of heat exchanger, thereby resulting in a limited installation location and application of the heat exchanger.

To resolve the above-stated problems, the present invention provides a heat exchanger of cooling type which does not require a tank or the like for coolant fluid with simple manufacturing technique and few working processes without causing breakage or the like on fin member, namely, the present invention enables easy manufacturing of the heat exchanger by simple technique and process, thereby enhancing productivity and obtaining inexpensive products. In order to enhance heat exchange ability by increasing contact frequency between the fluid flowing within the pipe main body and a heat transfer surface, the entire length of the pipe main body in the range of the heat exchanger is made longer and, even in such case, compact and light product can still be obtainable.

To resolve the above-stated problems, a first invention provides a heat exchanger comprising a fin member which is composed of a plurality of fins arranged in parallel and of which both opposing end surfaces are provided with a plurality of engagement grooves in parallel and at regular spaces, and a meandering pipe main body including a plurality of straight pipe sections to be disposed in the engagement grooves of the fin member, the plurality of straight pipe sections arranged in parallel and spaced by an opposing gap for fin member, a pair of meandering sections formed such that the plurality of straight pipe sections are joined through bend portions, the pair of meandering sections arranged so as to be opposed to each other spaced apart by an insertion gap for fin member, and a connection pipe for connecting a first meandering section and a second meandering section which are opposing to each other; wherein the fin member is placed within the insertion gap for fin member formed between the first meandering section and the second meandering section of the meandering pipe main body and wherein the straight pipe sections of the first meandering section are disposed in the engagement grooves on a first end surface of the fin member, and the straight pipe sections of the second meandering section are disposed in the engagement grooves on a second surface of the fin member for securing.

A second invention provides A heat exchanger comprising a plurality of fin members composed of a plurality of fins arranged in parallel and of which both opposing end surfaces are provided with a plurality of engagement grooves in parallel and at regular spaces, and a meandering pipe main body including a plurality of straight pipe sections to be disposed in the engagement grooves of the fin members, the plurality of straight pipe sections arranged in parallel and spaced by an opposing gap for the fin members, a pair of meandering sections formed such that the plurality of straight pipe sections are joined through bend portions, the pair of meandering sections arranged so as to be opposed to each other spaced apart by an insertion gap for fin members, and a connection pipe for connecting a first meandering section and a second meandering section which are opposing to each other, wherein the opposing straight pipe sections of the first and the second meandering sections of the meandering pipe main section are paired and, within a plurality of the insertion gap for the fin members formed in tiered manner between a plurality of pair of adjacent straight pipe sections, each fin member is placed so as to lie astride the first and the second meandering sections and wherein the straight pipe sections of the first meandering section are disposed in the engagement grooves on a first end surface of the fin members, and the straight pipe sections of the second meandering section are disposed in the engagement grooves on a second surface of the fin members for securing.

A fin member may be provided with an outside of the opposing section of at least one of the first meandering section and the second meandering section, and an exterior surface of each straight pipe section is disposed in the corresponding engagement groove of this fin member to secure them together.

A fin member may be provided with an outside of at least one of the outermost pairs of the straight pipe sections of the first meandering section and the second meandering section, and an exterior surface of each straight pipe section is disposed in the corresponding engagement groove of this fin member.

The fin member is composed of a plurality of plate-like fins arranged in parallel. Each fin member may be provided with engagement grooves at both opposing edges of each fin.

Each fin member may be formed of corrugated fins, i.e., a plate material is bent into a corrugated shape. The engagement grooves may be formed at both opposing end surfaces of the bend surface sides of the corrugated fins.

Each fin member may be formed of corrugated fins, i.e., a plate material is bent into a corrugated shape. The engagement grooves may be formed at both opposing end surfaces of the non-bend surface sides of the corrugated fins.

The engagement grooves may be formed by cutting off the fin members into concave shapes.

The engagement grooves may be formed by press-deforming the fin members into concave shapes.

The press-deformation of each fin member into a concave shape may be performed in such a manner that swelling collars are extending both sides of each fin by this press-deformation, thus formed adjacent swelling collars are placed near to or contact each other. The swelling collars further may be brought into surface-contact with the outer periphery surface of the meandering pipe main body.

The meandering pipe main body may be structured in such a manner that each straight pipe section having a diameter larger than a width of each engagement groove is press-inserted into the corresponding engagement groove.

The meandering pipe main body may be structured in such a manner that each straight pipe section is formed into a compressed shape and a shorter diameter of this compressed straight pipe section is sized smaller than a width of the corresponding engagement groove. After the compressed straight pipe section is disposed in the corresponding engagement groove such that a larger diameter is oriented to a bottom-opening direction of the engagement groove, the straight pipe section is expanded to allow an outer peripheral surface of the pipe to tightly fit into the engagement groove.

The meandering pipe main body may be so structured that straight pipe sections of the first meandering section and straight pipe sections of the second meandering section are curved into arc shapes to cause the both opposing surfaces to swell inwardly and thus the arc shaped straight pipe sections may be engaged through engagement means with the engagement grooves linearly.

The meandering pipe main body may be so structured that the corresponding bend portions of the first meandering section and the second meandering section may be clipped by clipping members.

The fin member arranged outside the first meandering section and/or the second meandering section may be clipped by a clipping member.

The meandering pipe main body and fin members may be bonded together, after disposing the straight pipe sections in the engagement grooves, by filling molten resin in the contact portions therebetween.

The meandering pipe main body may be covered by a resin layer around the outer peripheral surface thereof.

The resin layer covering the outer peripheral surface of the meandering pipe main body may be formed of thermoplastic resin material and, after disposing the straight pipe sections in the engagement grooves, the thermoplastic resin material may be fused by means of heating to have the engagement grooves of fin members be fuse-bonded with the straight pipe sections through the resin covering layer.

The meandering pipe main body and fin members may be provided with coating processing at their outer surfaces after straight pipe sections are disposed in engagement grooves.

A connection pipe between the first meandering section and the second meandering section, of which straight pipe sections are disposed in parallel, are twisted into a circumferential direction with regard to axis directions of the straight pipe sections, thereby a distance between the first meandering section and the second meandering section being narrowed.

The connection pipe between the first meandering section and the second meandering section is curved at one side of the straight pipe section outwardly and twisted toward the circumferential direction with regard to the axis directions of the straight pipe sections, thereby the distance between the first meandering section and the second meandering section can be narrowed and the straight pipe sections of the first meandering section and the second meandering section may also be arranged in parallel to each other.

The fin members may be provided with inclined surfaces by bending at least of end sides of each fin.

The fin members may have each fin formed with a plurality of flow channels.

The present invention has such a structure as described above that the opposing end surfaces of the fin member include the concave shaped engagement grooves which engage with the straight pipe sections of meandering pipe main body to form heat exchanger, so that comparing to the conventional technique in which a pipe main body is inserted into breakthroughs of a fin member, a heat exchanger according to the present invention is easy to manufacture as well as fin member thereof is less subjected to damages. As such, the durability of products improves and easy manufacturing thereof is achieved. Further, simplification of manufacturing technique and manufacturing steps can minimize manufacturing cost, thereby realizing to produce inexpensive products. Furthermore, according to the present invention, the pipe meanders in order to elongate the pipe, i.e., a flow channel in which fluid flows becomes longer, the contact frequency between the fluid flowing therein and the heat transmission surface becomes high. Therefore, effective discharge/absorption of heat though a heat transmission surface of the pipe main body can be achieved between an interior fluid and an exterior fluid. Thus, the heat exchanger of excellent heat exchanging ability is obtainable. Still further, use of meandering pipe main body realizes a non-bulky product in dual direction and a product compact in size as well as having high freedom in layout, i.e., such product requires just a small space as an underfloor of vehicles and the rearward of apparatuses.

DETAILED DESCRIPTION OF PREFERRED EMBODIMENTS OF THE INVENTION

Figure 1:
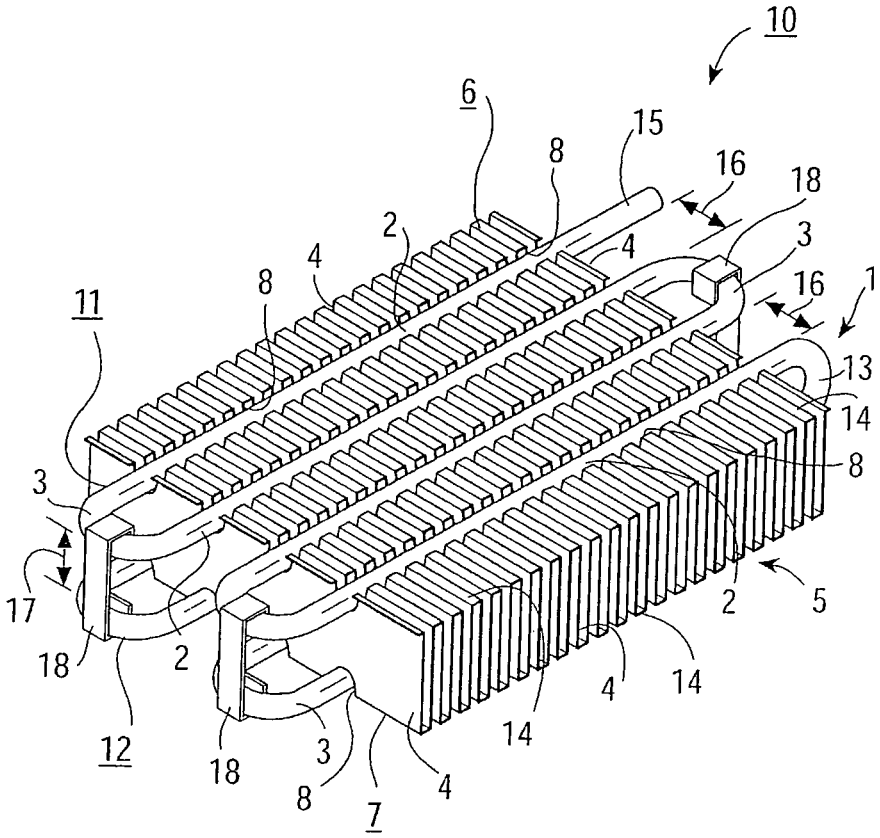
FIG. 1 is a perspective view of a heat exchanger according to a first embodiment.
Figure 2:
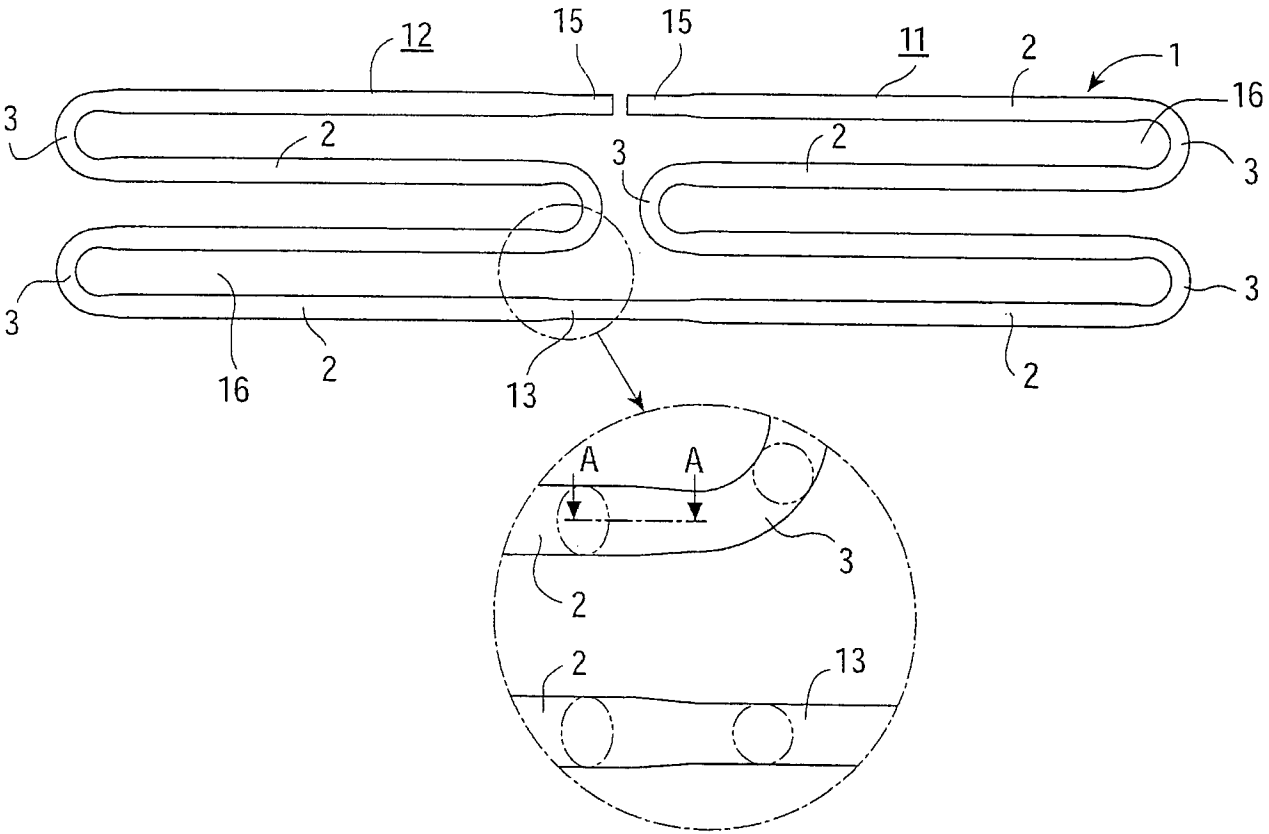
FIG. 2 is a plane view of a meandering pipe main body having a first meandering section and a second meandering section formed therewith.
Figure 3:
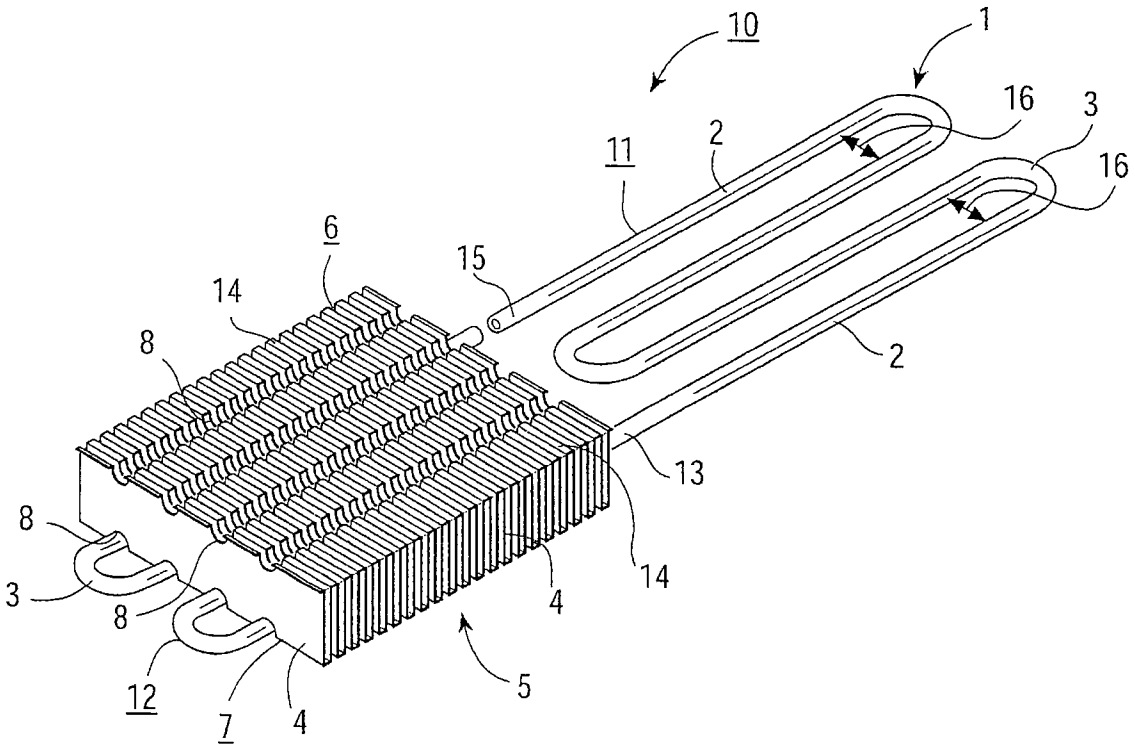
FIG. 3 is a perspective view showing a state that a fin member is disposed on the second meandering section.
Figure 4:
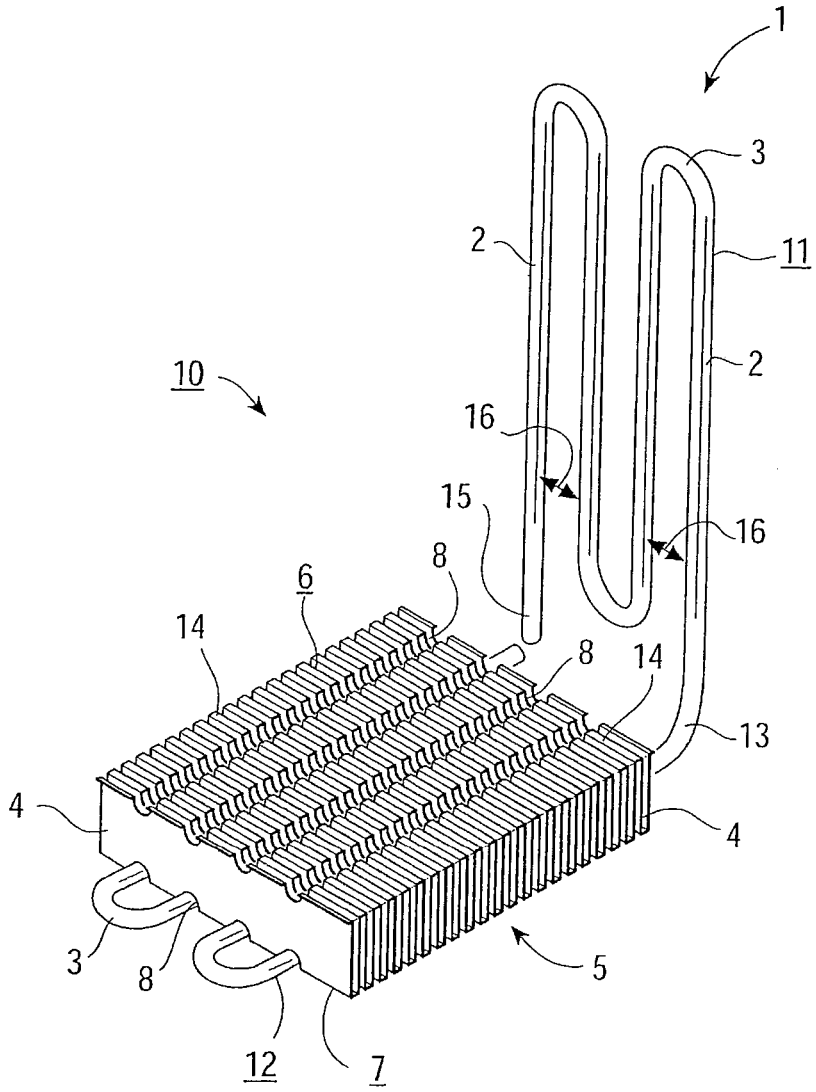
FIG. 4 is a perspective view showing that a connection pipe is bent to place the first meandering section on the first end surface of the fin member.
Figure 5:
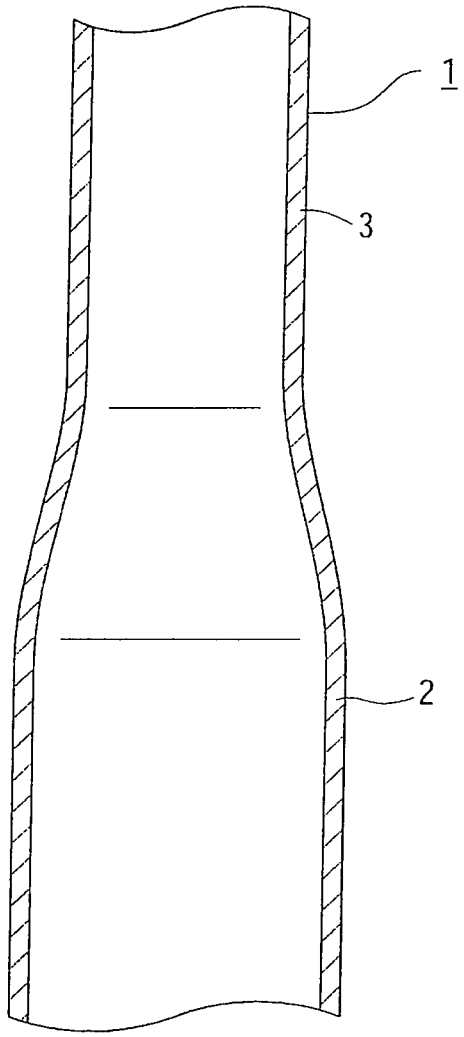
FIG. 5 is a partially enlarged cross sectional view taken along A-A line of FIG. 2.
Figure 6:
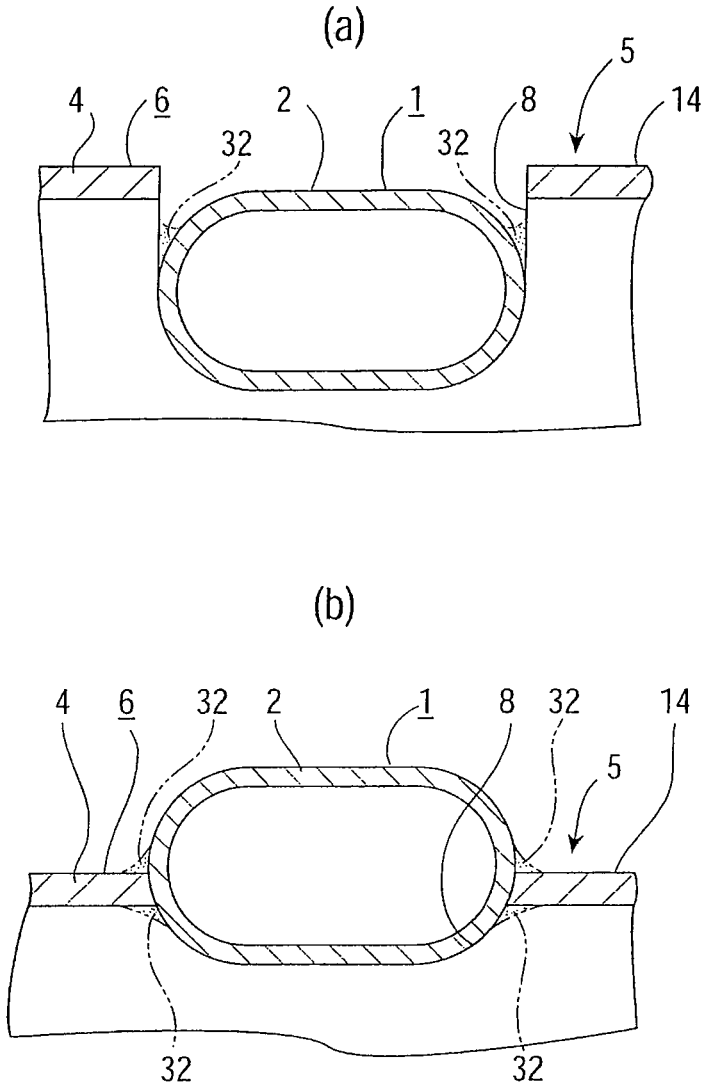
FIG. 6 are enlarged views of engagement grooves and straight pipe sections disposed therein.
Figure 7:
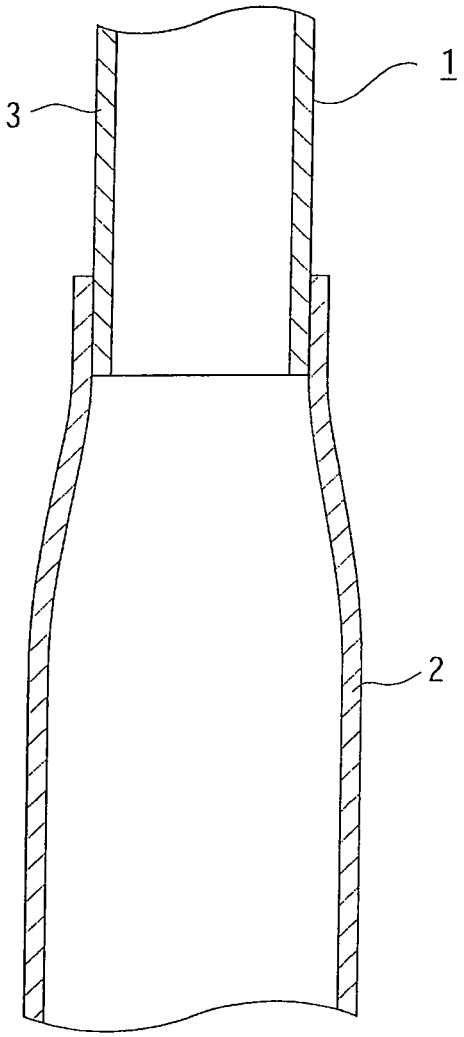
FIG. 7 is an enlarged sectional view showing a vicinity of a boundary between the straight pipe section and a bend portion of the meandering pipe main body according to the second embodiment.
Figure 8:
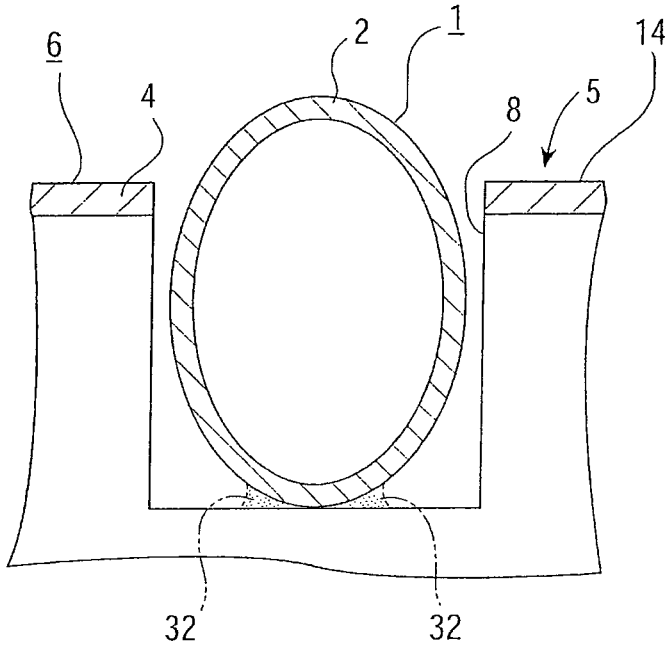
FIG. 8 is an enlarged cross sectional view showing a state that the straight pipe section of the meandering pipe main body according to the third embodiment is disposed in the engagement groove.
Figure 9:
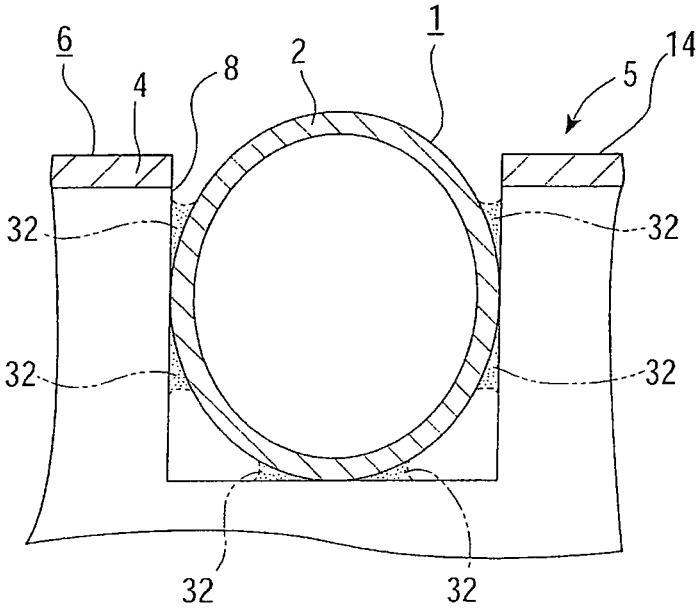
FIG. 9 is an enlarged cross sectional view showing a state that the straight pipe section is expanded to be tightly fit in the engagement groove.

Hereinafter, the embodiments of the heat exchanger according to the first and the second inventions are explained into details with reference to the drawings. The embodiments 1 to 8 describe the first invention and the embodiments 9 and 10 describe the second invention. FIG. 1 is a perspective view of a heat exchanger according to the first embodiment, illustrating that a fin member is placed in an insertion gap formed between a first meandering section and a second meandering section. FIGS. 2 to 6 illustrate manufacturing steps of the heat exchanger according to the first embodiment and specifically, FIG. 2 is a plane view of a meandering pipe main body in which a pair of the meandering sections are formed in line symmetry. FIG. 3 is a perspective view illustrating that the fin member is placed on the second meandering section and the straight pipe sections of the second meandering section are disposed in the engagement grooves on the second end surface of the fin member. FIG. 4 is a perspective view illustrating a state in process of bending a connection pipe and placing the first meandering section onto the first end surface of the fin member. FIG. 5 is an enlarged cross sectional view taken along A-A of FIG. 2 illustrating the vicinity of a boundary portion between the straight pipe section having an oval shaped cross section and a bend portion of a circle shaped cross section. FIG. 6 are enlarged cross sectional views of the engagement grooves and the straight pipe sections disposed in the engagement grooves, and more specifically, FIG. 6(*a*) illustrates a straight pipe section that its entirety is disposed in a deep engagement groove and FIG. 6(*b*) illustrates a straight pipe section that its lower half is disposed in a shallow engagement groove. FIG. 7 is an enlarged cross sectional view showing the vicinity of a boundary between a straight pipe section of the meandering pipe main body and a bend portion, wherein an independent straight pipe section of a compressed shape and a bend portion of a circular shape are connected to each other. FIG. 8 is an enlarged cross sectional view immediately after a straight pipe section is disposed in an engagement groove according to the third embodiment. FIG. 9 is an enlarged cross sectional view illustrating that a straight pipe section is expanded to have itself tightly fit into an engagement groove.

Figure 10:
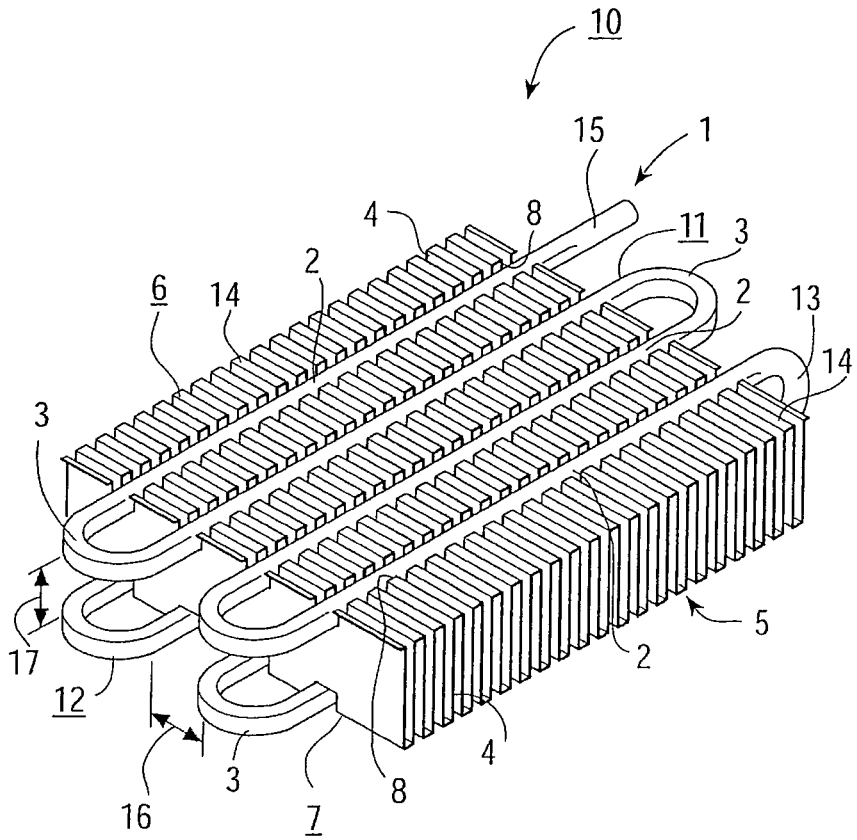
FIG. 10 is a perspective view of the heat exchanger according to the fourth embodiment.
Figure 11:
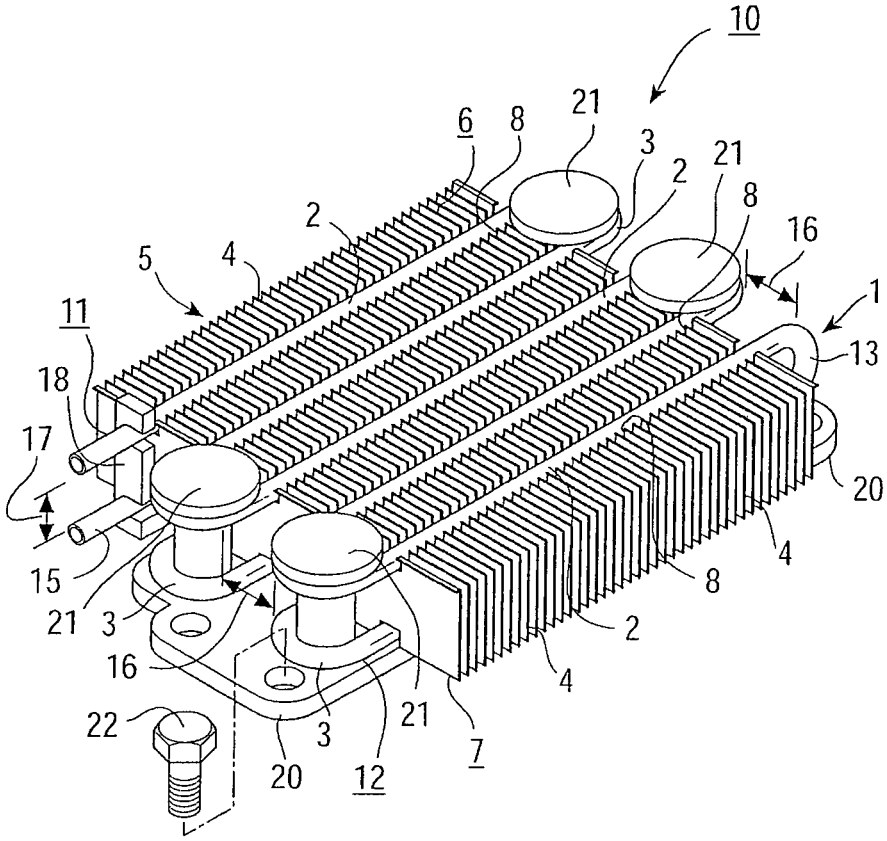
FIG. 11 is a perspective view of the heat exchanger according to the fifth embodiment.
Figure 12:
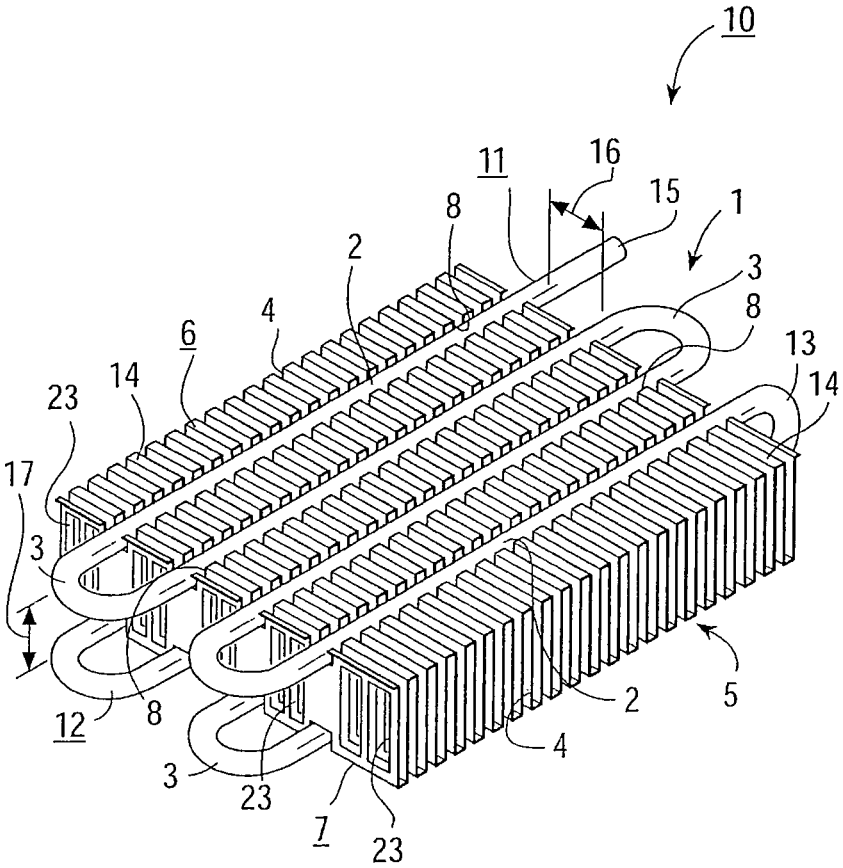
FIG. 12 is a perspective view of the heat exchanger according to the sixth embodiment.
Figure 13:
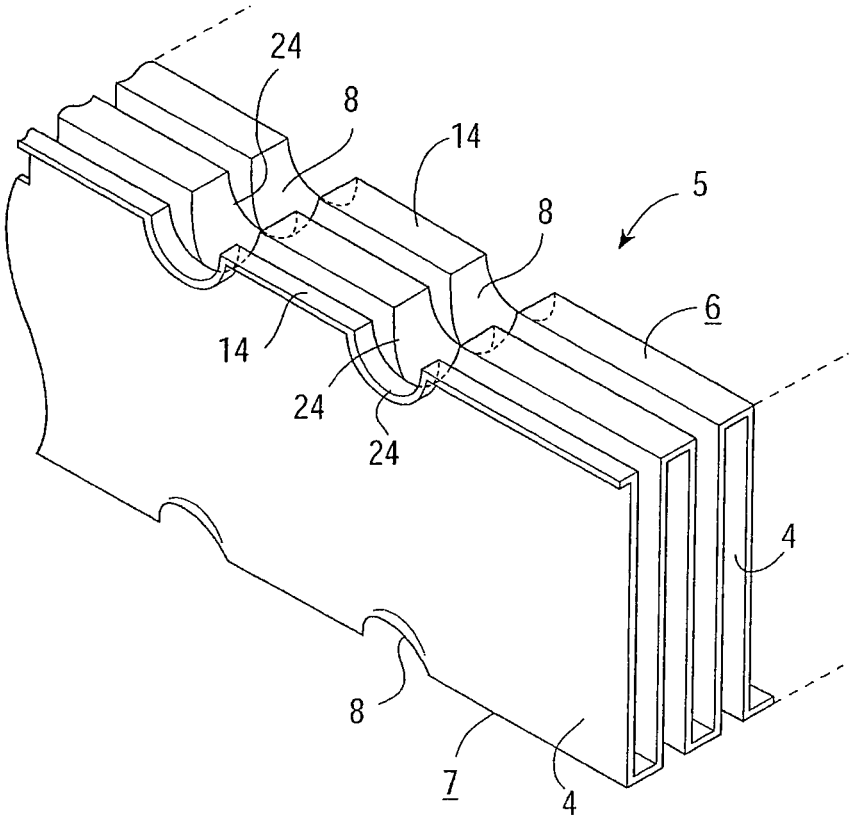
FIG. 13 is a partial perspective view of the fin member according to the seventh embodiment.
Figure 14:
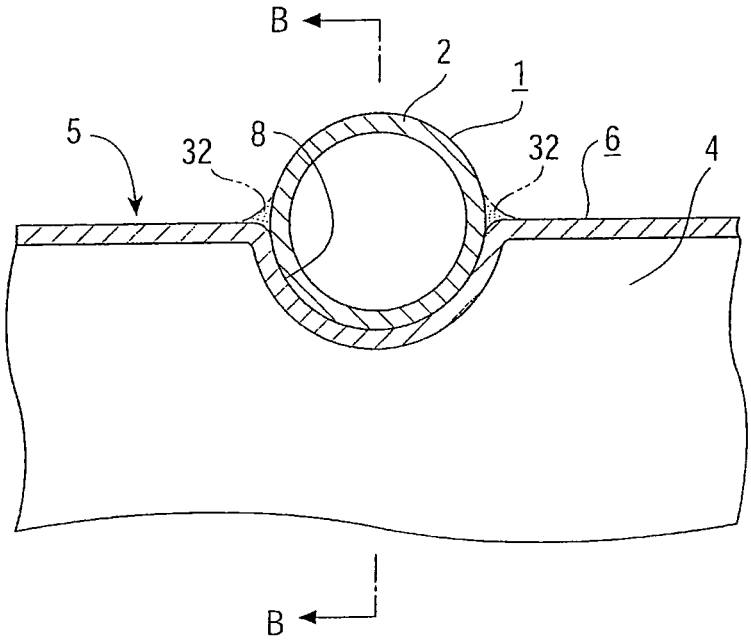
FIG. 14 is an enlarged cross sectional view of the engagement groove of the fin member of FIG. 13 and the straight pipe section disposed therein.
Figure 15:
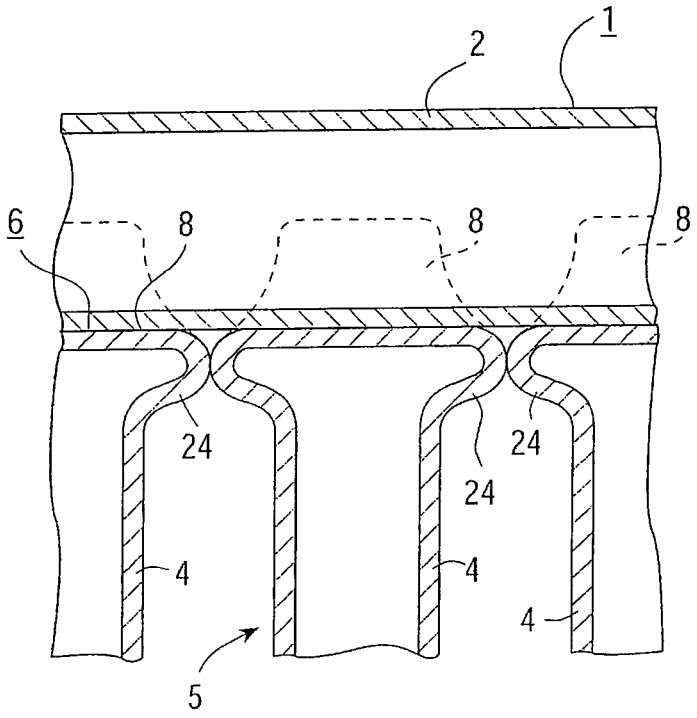
FIG. 15 is a cross sectional view taken along line B-B of FIG. 14.
Figure 16:
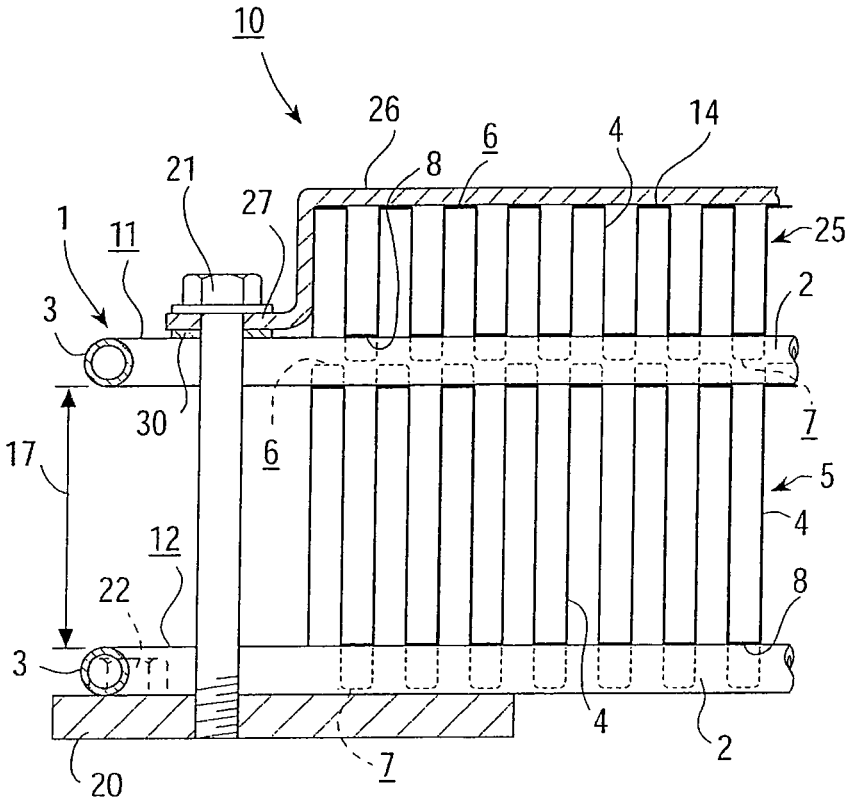
FIG. 16 is a cross sectional view of the heat exchanger according to the eighth embodiment.
Figure 17:
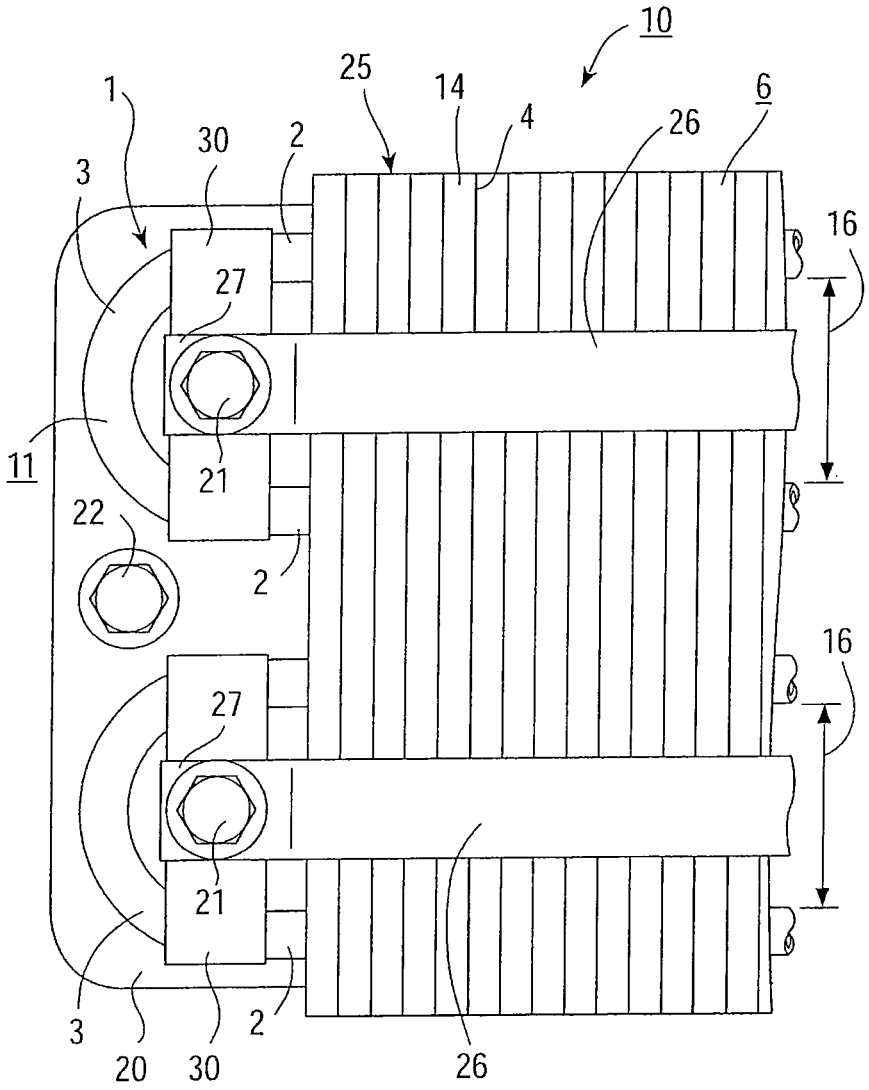
FIG. 17 is a plane view of FIG. 16.

FIG. 10 is a perspective view of the heat exchanger according to the fourth embodiment, illustrating that the straight pipe sections and the bend portions of the meandering pipe main body are molded to have compressed rectangular shapes in cross sections thereof. FIG. 11 is a perspective view of the heat exchanger according to the fifth embodiment, illustrating that the fin member is formed with plate-like fins arranged in parallel. FIG. 12 is a perspective view of the heat exchanger according to the sixth embodiment, illustrating that each fin of the fin member is provided with a plurality of flow channels for causing a turbulent flow in the exterior fluid. FIG. 13 is a perspective view of the fin member according to the seventh embodiment. FIG. 14 is an enlarged cross sectional view illustrating that a straight pipe section is disposed in an engagement groove of the fin member of FIG. 13. FIG. 15 is a cross sectional view taken along the line B-B of FIG. 14. FIG. 16 is a cross sectional view of the heat exchanger according to the eighth embodiment, illustrating that an extra fin member is placed outside the first meandering section, the fin member secured by a securing member onto meandering pipe main body. FIG. 17 is a plane view of the heat exchanger according to the eight embodiment.

Figure 18:
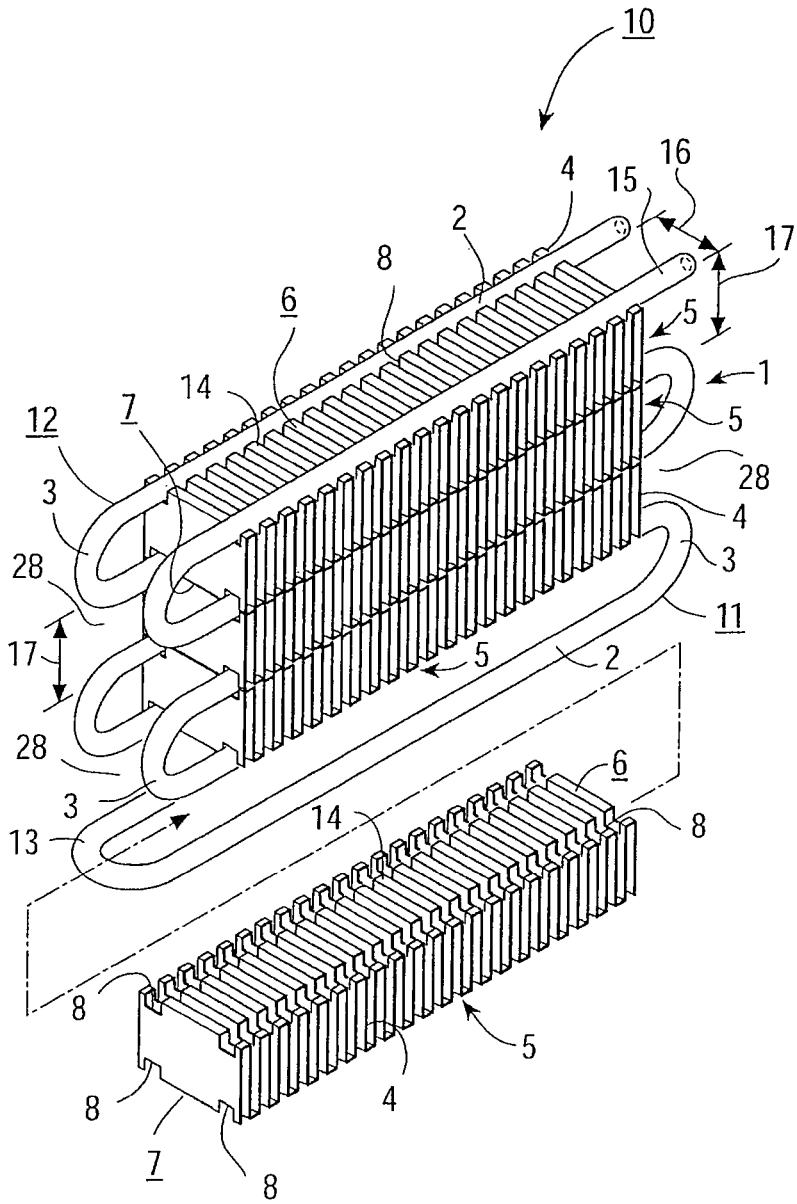
FIG. 18 is a perspective view of the heat exchanger according to the ninth embodiment.
Figure 19:
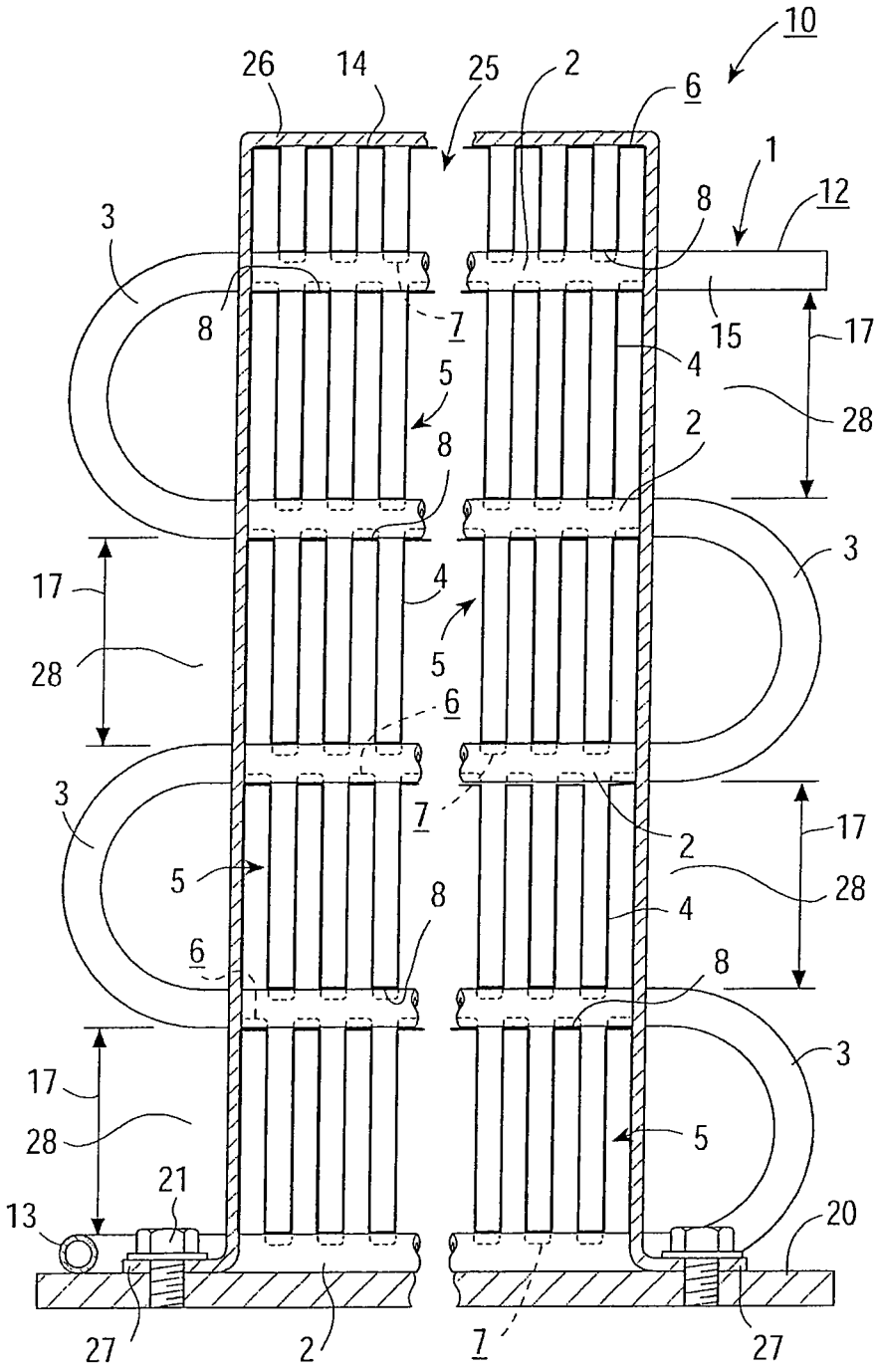
FIG. 19 is a cross sectional view of the heat exchanger according to the tenth embodiment.
Figure 20:
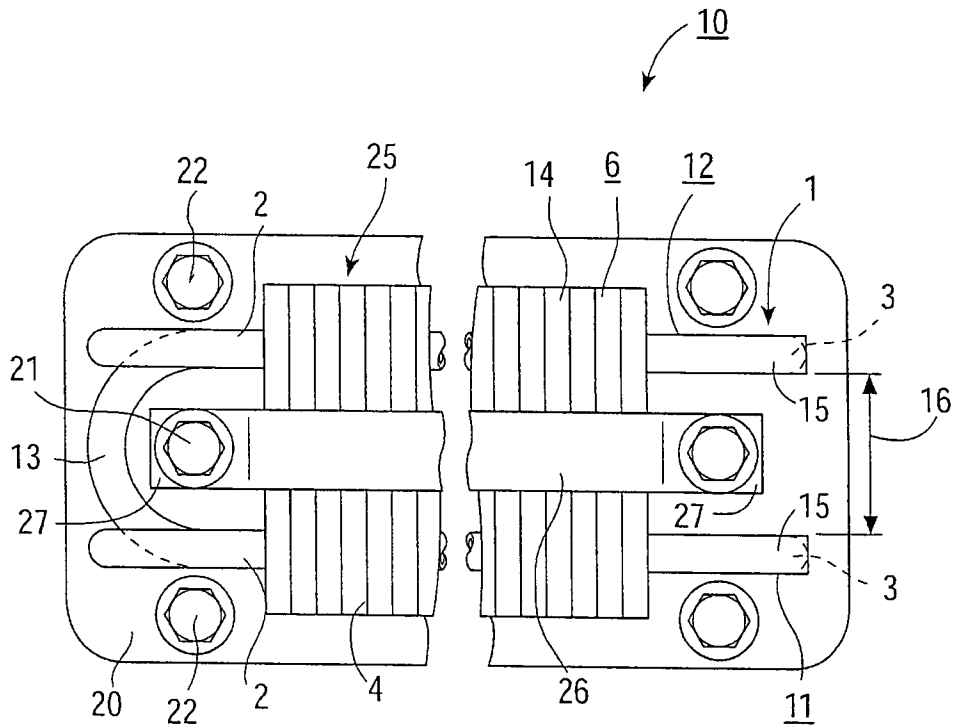
FIG. 20 is a plane view of FIG. 19.
Figure 21:
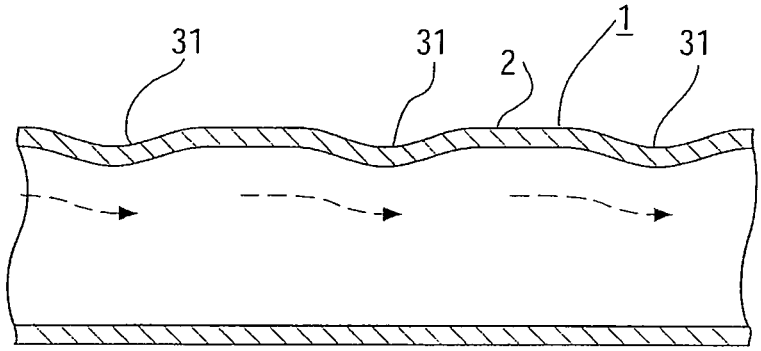
FIG. 21 is a partially enlarged cross sectional view of the straight pipe section of the meandering pipe main body according to the embodiment 11 having the concave/convex portions formed thereon.

FIG. 18 is a perspective view of the heat exchanger according to the ninth embodiment, illustrating that the fin members are provided with a plurality of insertion gaps, the insertion gaps formed in a tiered manner between the straight pipe sections. FIG. 19 is a cross sectional view of the heat exchanger according to the tenth embodiment, illustrating that the fin members are placed within the insertion gaps between the straight pipe sections and further placed outside a pair of the uppermost end straight pipe sections and secured by securing members on the meandering pipe main body. FIG. 20 is a plane view showing the heat exchanger according to the tenth embodiment. FIG. 21 is a partially enlarged cross sectional view of the straight pipe section in a case where each of the meandering pipe main bodies is provided with concave/convex portions.

In FIGS. 6, 8, 9 and 14 illustrating the embodiments 12 to 14, fillets made of resin material are indicated by chain double-dashed lines, respectively, in a case where molten resin is filled at portions where the engagement groove and the straight pipe section contact with each other in order to bond them together and in a case where the resin-layer covering the meandering pipe main body and the fin member are put together in order to bond them together by melting the resin layer.

Figure 22:
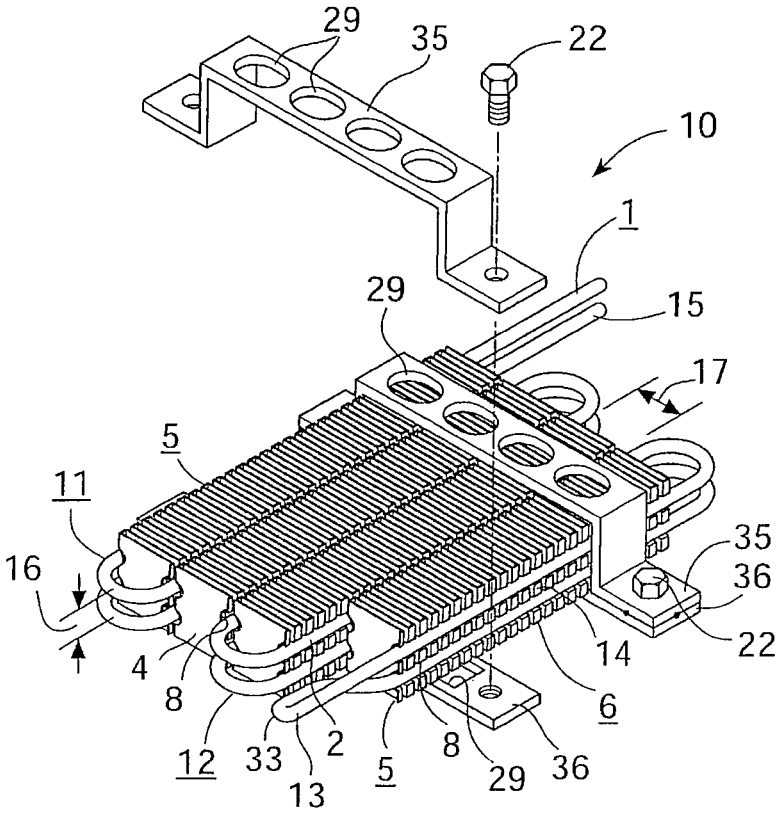
FIG. 22 is a perspective view of the heat exchanger according to the fifteenth embodiment.
Figure 23:
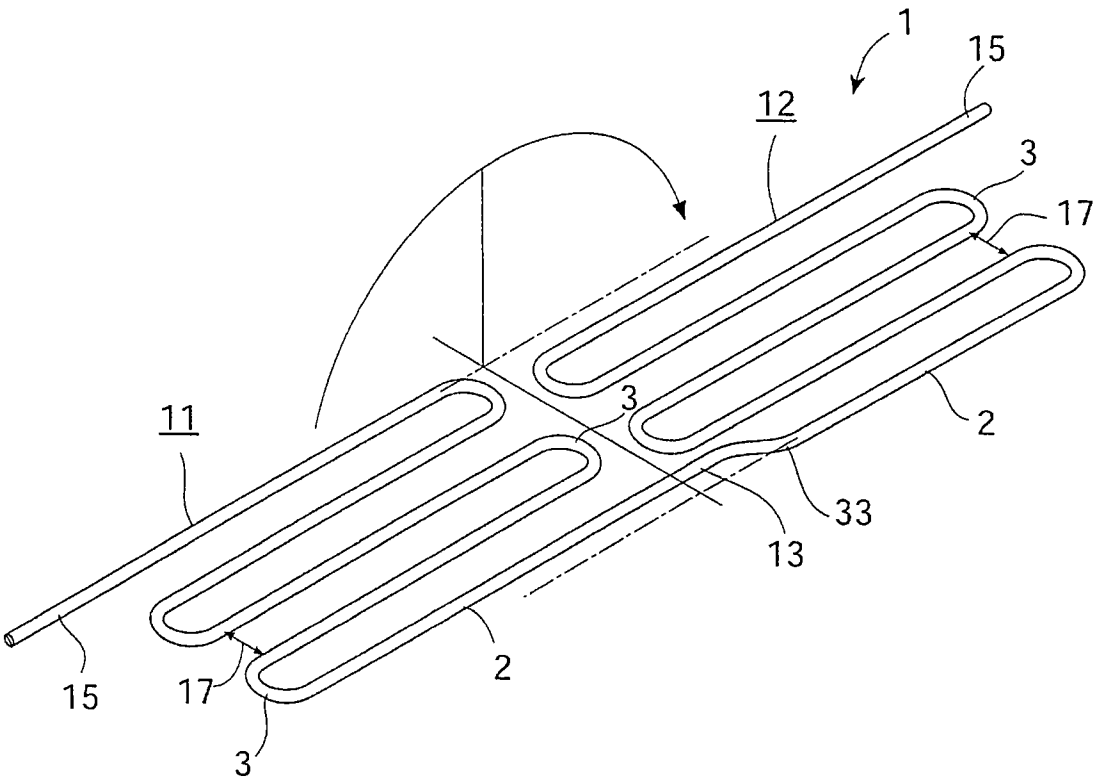
FIG. 23 is a perspective view of the first and the second meandering sections according to the fifteenth embodiment.
Figure 24:
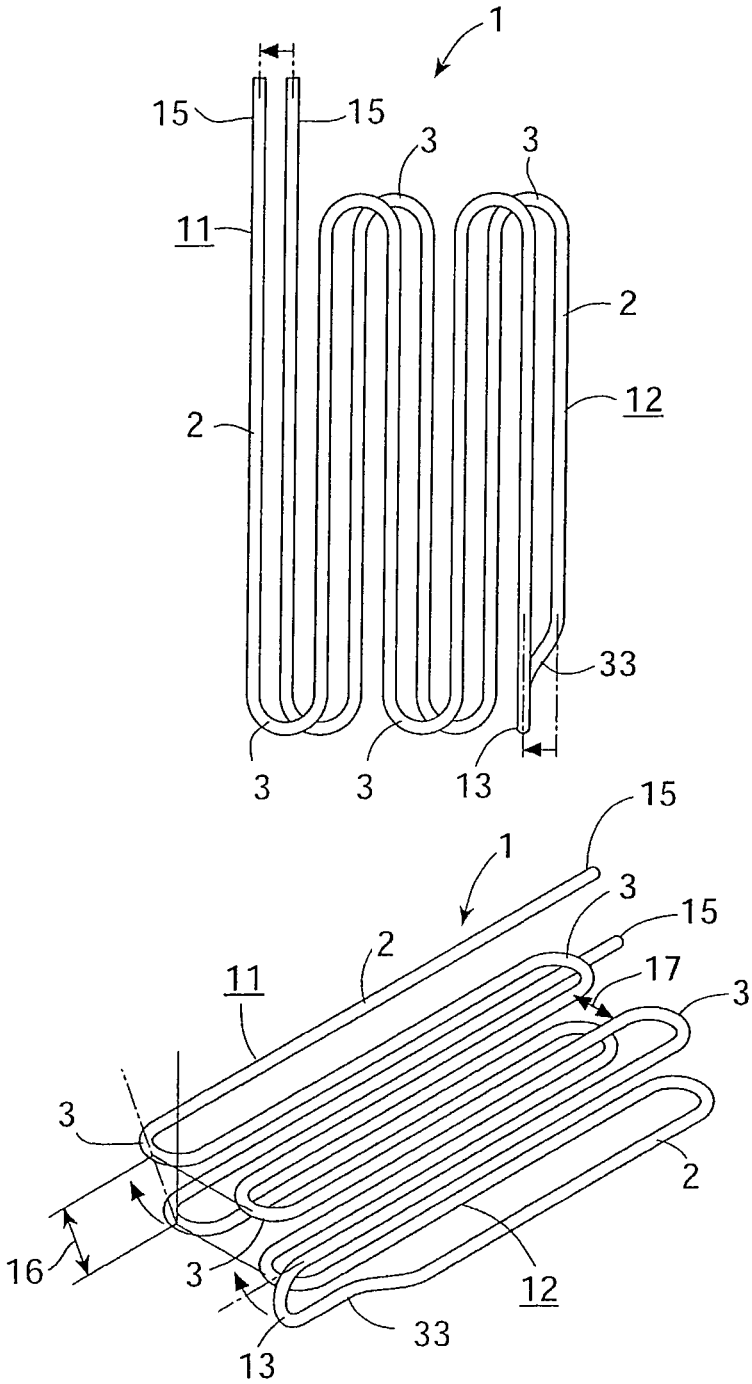
FIG. 24 are a perspective view and a plane view respectively showing a state that a connection pipe is bent and the first and the second meandering sections are opposed to each other.
Figure 25:
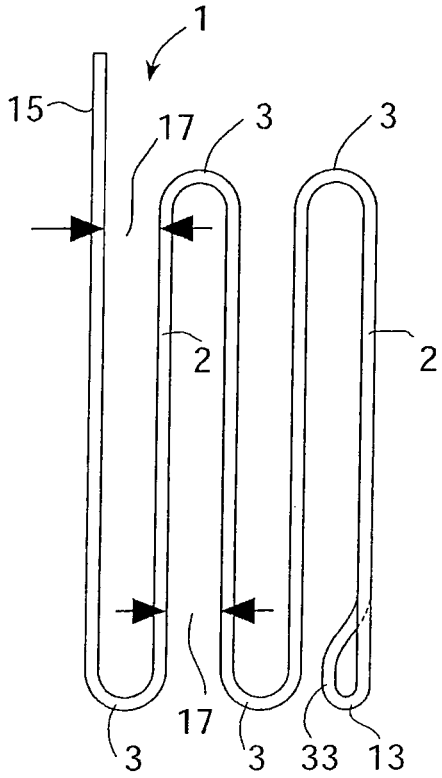
FIG. 25 are a perspective view and a plane view respectively showing the meandering main pipe in a state that the connection pipe is twisted, a state that the opposing distance between the first and the second meandering sections are narrowed and a perspective view of fin member.
Figure 25:
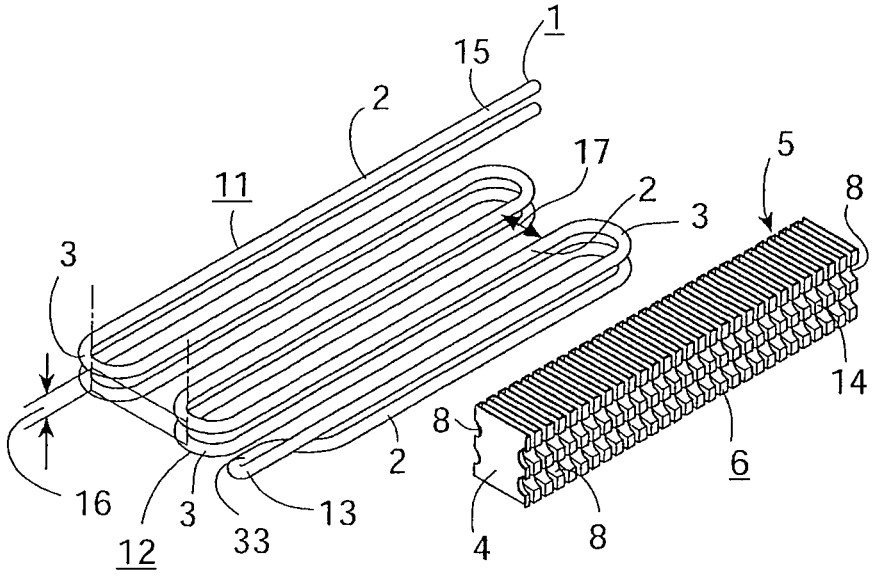

FIG. 22 is a perspective view of the heat exchanger according to the fifteenth embodiment, illustrating that an opposing distance between the first meandering section and the second meandering section is narrowed to produce a thinner product. FIG. 23 is a plane view illustrating that the first meandering section and the second meandering section are disposed upon displaced to each other. FIG. 24 are a perspective view and a plane view respectively illustrating that the connection pipe is bent and the first and the second meandering sections are opposed to each other. FIG. 25 are a perspective view and a plane view illustrating that a twist of the curving portion of the connection pipe narrows the opposing distance between the first and the second meandering sections and a perspective view of a fin member, respectively.

Figure 26:
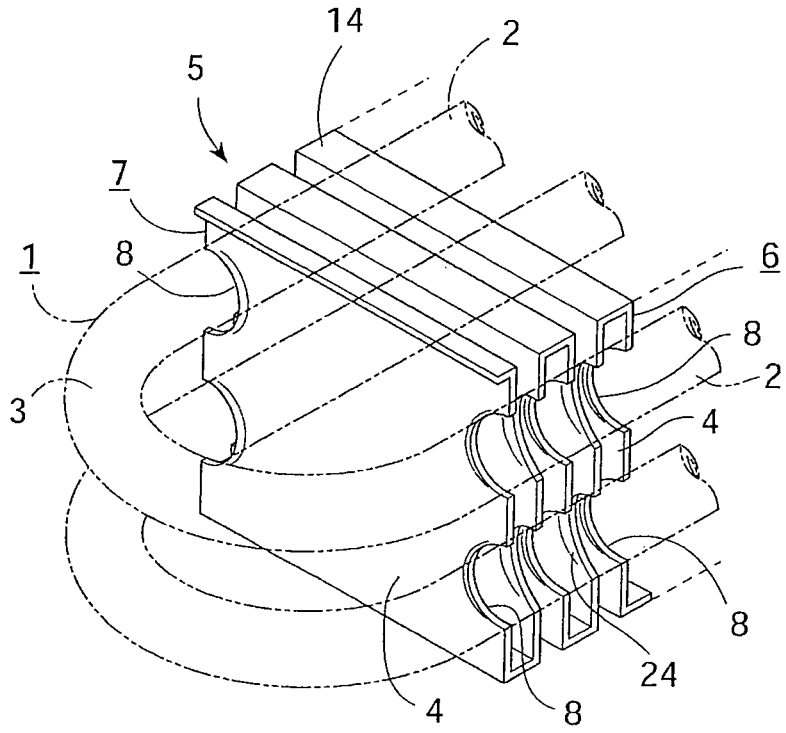
FIG. 26 is a partially enlarged perspective view of the heat exchanger according to the sixteenth embodiment.
Figure 27:
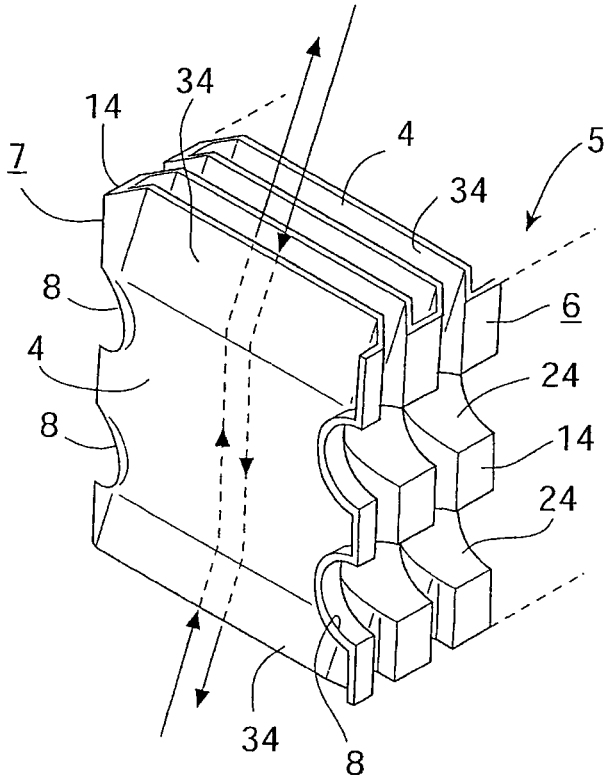
FIG. 27 is a perspective view of the fin member to be used in the heat exchanger according to the seventeenth embodiment.
Figure 28:
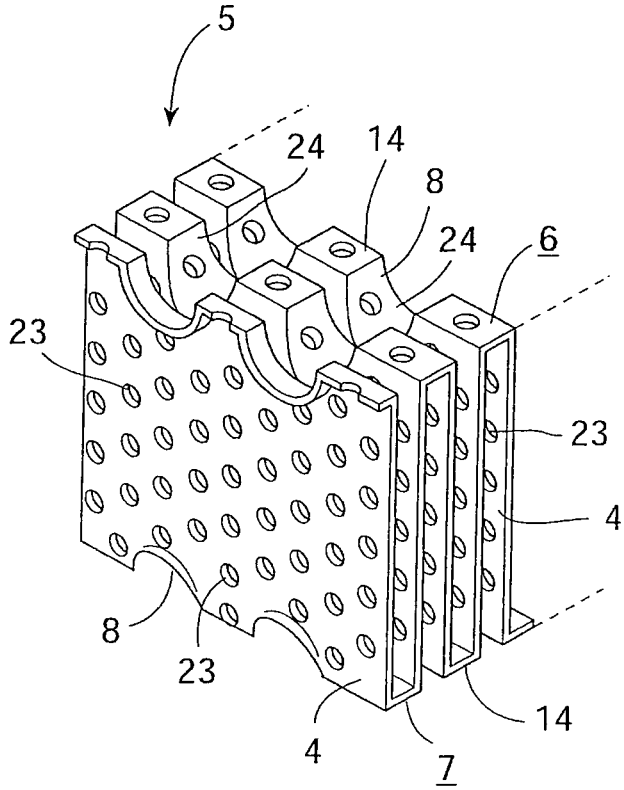
FIG. 28 is a perspective view of the fin member to be used in the heat exchanger according to the eighteenth embodiment.

FIG. 26 is an enlarged perspective view of the heat exchanger according to the sixteenth embodiment, illustrating an engagement condition between a fin member and a straight pipe section, wherein both ends of a non-bend portion of the corrugated fin member are provided with the engagement grooves. FIG. 27 is a perspective view of a fin member used for the heat exchanger according to the seventeenth embodiment, illustrating that ends of each fin are bent to form inclined surfaces. FIG. 28 is a perspective view of a fin member to be used in the heat exchanger according to the eighteenth embodiment, wherein each fin is provided with a plurality of circular flow channels punched by a punching plate.

The first embodiment in which the heat exchanger according to the present invention is exemplified as a fuel pipe to be disposed onto an underfloor of vehicles is hereinafter explained into detail referring to FIGS. 1 to 6. (1) denotes a meandering pipe main body in which a pair of meandering sections (11), (12), composed of a plurality of straight pipe sections (2) arranged in parallel with desired opposing gaps (16) between the straight pipe sections (2) and bend portions (3) for connecting the plurality of straight pipe sections (2), are placed within insertion gap (17) for a fin member so as to be opposed to each other. Within insertion gap (17) formed between the first meandering section (11) and the second meandering section (12), there is placed fin member (5) provided with a plurality of rectangular shaped engagement grooves (8) at constant distances on both end surfaces (6), (7) opposing to each other and composed of a plurality of fins (4) in parallel. Further, straight pipe sections (2) are disposed in the engagement grooves (8) and secured therein to form heat exchanger (10).

An example of manufacturing process of the above-stated heat exchanger (10) will be explained below. Firstly, meandering pipe main body (1) is formed in such a manner that a single metal pipe formed, for example, of iron, stainless steel, copper, alminium, copper based alloy or aliminium based alloy is bent, as shown in FIG. 2, to form the first meandering section (11) disposed on the first end surface (6) side of fin member (5) and the second meandering section (12) disposed on the second end surface (7) side in line symmetry. The pair of meandering sections (11), (12) are composed of a plurality of straight pipe sections (2) arranged in parallel spaced by an opposing gap (16) and bend portions (3) for connecting straight pipe sections (2). The first meandering section (11) and the second meandering section (12) are connected to each other though connection pipe (13). This connection pipe (13) is so formed as to be longer than a distance between opposing engagement grooves (8) both end surfaces (6), (7) of fin member (5), thereby enabling opposing placement of the pair of the meandering sections (11), (12) on both end surfaces (6), (7) without trouble.

In meandering pipe main body (1), only straight pipe sections (2) are formed, as shown in FIGS. 2, 6(*a*) and 6(*b*), in oval compressed shapes in cross sections in directions perpendicular to pipe axes. Thus formed each oval straight pipe section (2) is disposed in such a manner, as shown in FIGS. 6(*a*) and 6(*b*), that a longer diameter of the oval is oriented in a width direction of the corresponding engagement groove (8) as well as a shorter diameter of the oval is oriented in bottom-to-opening direction of the corresponding engagement groove (8). Accordingly, a contacting area between straight pipe section (2) and the corresponding engagement groove (8) becomes large which will enhance the heat conductivity between fin member (5) and straight pipe sections (2). Each engagement groove (8) may be formed to have a larger height than a shorter diameter of the corresponding straight pipe section (2) in order to receive therein the entirety of the corresponding straight pipe section (2) as shown in FIG. 6(*a*). Each engagement groove (8) may also be formed to have such a shallow height as approximately half length of the shorter diameter of the corresponding straight pipe section (2) so as to allow the lower half of straight pipe section (2) to be disposed in the corresponding engagement groove (8). On the other hand, bend portions (3) and connection pipe (13) are not formed in oval compressed shapes but are formed in circular shapes in cross section. Pipe ends of meandering pipe main body (1) serve as joint pipes (15) to be connected to a rubber hose or the like. Joint pipes (15) are not formed in compressed shapes but are formed in circular shapes in cross section. For the sake of avoiding inadvertent disconnection with the rubber hose or the like, sprue processing or bulging may be provided with the joint pipes (15).

In this embodiment, as stated above, since meandering pipe main body (1) is made by bending a single metal pipe, straight pipe sections (2) and bend portions (3), straight pipe sections (2) and connection pipes (13), and straight pipe sections (2) and joint pipes (15) are continuous, respectively, i.e., seamless, as shown in FIG. 5. FIG. 5 is a cross sectional view taken along the line A-A of FIG. 2, that is, a cross sectional view illustrating the vicinity of the boundary between straight pipe section (2) and bend portion (3) in larger diameter direction of the oval straight pipe section (2).

Fin member (5) which receives meandering pipe main body (1), according to the first embodiment, is formed of a sheet of metal plate made of iron, stainless steel, copper, alminium, copper based alloy, alminium based alloy or the like by bending the plate in a corrugate shape spaced by the plurality of bend portions (14) so as to form the plurality of fins (4) arranged in parallel. The both end surfaces (6), (7) opposing to each other including bend portions (14) of fin member (5) are provided with oval engagement grooves (8) receiving straight pipe sections (2) such that the number of grooves corresponds to that of straight pipe sections (2) and that the grooves are spaced by distances identical to opposing gaps (16) between straight pipe sections (2). Also, in this embodiment, engagement grooves (8) are formed such that the both end surfaces (6), (7) of fin member (5) are cut off to form the grooves having oval shapes which corresponds to the appearances of straight pipe sections (2), respectively.

A process to put fin member (5) as stated above together with meandering pipe main body (1) is explained below. As shown in FIG. 3, fin member (5) is placed on an upper surface of the second meandering section (12) of meandering pipe main body (1), and engagement grooves (8) of the second end surface (7) of fin member (5) receives straight pipe sections (2) of the second meandering section (12) so as to allow the longer diameters of the pipes to orient in width directions of engagement grooves (8), and the shorter diameters of the pipes to orient in the bottom-to-opening directions, i.e., straight pipe sections (2) are disposed in engagement grooves (8) in horizontal positions. Then, connection pipe (13) of meandering pipe main body (1) is bent by a bending roll (not shown) or the like and therefore meandering pipe main body (1) is folded into two as shown in FIG. 4 to allow the first meandering section (11) to be positioned facing to the first end surface (6) of fin member (5).

As shown in FIGS. 6(*a*) and 6(*b*), each straight pipe section (2) of the first meandering section (11) is disposed in the corresponding engagement groove (8) of the first end surface (6) such that the larger diameter of the pipe is oriented in the width direction of the corresponding engagement groove (8) and the shorter direction is oriented in the bottom-to-opening direction of the corresponding engagement groove (8), namely, the pipe is disposed in the corresponding engagement groove (8) in a horizontal position. Since engagement grooves (8) are formed in the oval shapes which correspond to the appearances of straight pipe sections (2), stable engagement of straight pipe sections (2) in engagement grooves (8) is achieved without a stagger as well as there occurs surface-contacts between engagement grooves (8) with thickness and straight pipe sections (2). Consequently, through the contacting portion between straight pipe sections (2) and engagement grooves (8), a better heat conductivity can be realized between straight pipe sections (2) and fin member (5).

At the time of completing the placement, meandering pipe main body (1) and fin member (5) are secured only by a gripping force of the first and the second meandering sections (11), (12) in a direction of insertion gap (17). Here, to improve securing stability of meandering pipe main body (1) with respect to fin member (5) and further heat conductivity by ensuring the surface contacts between straight pipe sections (2) and engagement grooves (8), in the present embodiment, the opposing bend portions (3) of the first meandering section (11) and the second meandering section (12) as shown in FIG. 1 are clipped by clips (18) as clipping members. With such clipping by clips (18), securing of straight pipe sections (2) with engagement grooves (8) is not released easily, securing of meandering pipe main body (1) with fin member (5) becomes more tight, and resistance to vibration can be improved with regard to vibrations caused by vehicles in which heat exchanger (10) is installed or to flux of fluid. Also, straight pipe sections (2) surface-contact with engagement grooves (8) tightly, thereby enhancing the heat conductivity between straight pipe sections (2) and fin member (5). If required, clips (18) may be connected with securing brackets or the like of vehicles, thereby securing heat exchanger (10) on the vehicle body. The brackets or the other clamping members for the use of securing heat exchanger (10) can also be used as the clipping members for fin member (5) and meandering pipe main body (1).

In heat exchanger (10) having the above stated structure, since the pipe in which fluid such as fuel flows therein is designed to meander to form meandering pipe main body (1), a long flow pass is obtainable. Also, the placement of meandering pipe main body (1) on fin member (5) renders a heat-conductive area increase, so that the discharging/absorbing heat ability of the entire heat exchanger (10) can be improved. Further, a parallel flow of the outside fluid with regard to the heat conductive surface of each fin (4) of fin member (5) renders a heat exchange effective through each fin (4) between the fluid flowing in meandering pipe main body (1) and the outside fluid.

Meandering pipe main body (1) is composed of the pair of meandering sections (11), (12) by being preliminary formed in a meandering shape. Then, meandering pipe main body (1) is folded into two so as to simply sandwich fin member (5), thereby achieving securing of the meandering pipe main body (1) onto fin member (5). As such, simple manufacturing technique and only few manufacturing steps are required, leading to an improvement of productivity and inexpensive manufacturing of heat exchanger (10).

Since engagement grooves (8) in which straight pipe sections (2) are to be disposed are provided on both end surfaces (6), (7) of fin member (5) by cutting off portions of each fin (4), the manufacturing process becomes easier and the resulting fin member (5) is resistible to deformation and damage compared with what disclosed in Japanese Patent Laying-Open No. 2003-88924 where throughholes are provided in thin fins to allow a pipe main body to pass through fins. In this conventional art, it is also required that straight pipe sections inserted into the thin fins are expanded and thereafter are to be connected through a U-bent pipe, whereas in the first embodiment according to the present invention, a single metal pipe is bent into a meandering shape to form meandering pipe main body (1) and therefore the troubles of brazing, welding, or the like in the manufacturing process for establishing connection can be saved and further anxiety of a leakage of fuel can be eliminated. Further, since engagement grooves (8) and straight pipe sections (2) are secured with a gripping force of the first and the second meandering sections (11), (12) as well as the clips (18), the manufacturing process can further save the trouble of expansion of the pipes, resulting in an easy manufacturing.

Fin member (5) according to the first embodiment is formed such that a single metal plate is bent to form corrugate fins, so that fins (4) will not spread out during manufacturing, resulting in a good workability and enhanced impact resistance of fin member (5), thereby improving the permanence of heat exchanger (10). Further, because a plurality of bend portions (14) are provided with fin member (5), the heat conductible area can be increased and the heat exchange ability with the outside fluid can be improved as well. Still further, because meandering pipe main body (1) made by meandering the metal pipe is used, heat exchanger (10) according to the present invention will not be bulky but be in compact and also be light in weight comparing to those made by aluminium die-cast.

Consequently, use of this heat exchanger (10) as a fuel pipe can render excellent fuel cooling effect obtainable, and thus eliminate a necessity to prepare a fuel cooling means such as an independent cooler unit and reduce the number of parts to be needed, thereby reducing manufacturing cost for vehicles. The heat exchanger (10) according to the present invention further can be placed in a narrow space such as an underfloor, so that it may be placed in any kind of vehicle. In other words, heat exchanger of the present invention is excellent in freedom of layout and versatility.

There is a case where if bend portions (3) of the first and the second meandering sections (11), (12) are tightly clipped by a clipping means such as clips (18), and thus straight pipe sections (2) will deform upon projecting out of engagement grooves (8) in a floating manner due to the reaction of the tight clipping. In such case, the heat conductivity may be lowered. To resolve this problem, it is not shown but may be conducted that straight pipe sections (2) of the first and the second meandering sections (11), (12) are preliminary bent into arc shapes so the opposed surfaces as to swell inward to dispose straightly the curved straight pipe sections (2) in engagement grooves (8), and then straight pipe sections (2) are disposed straightly in engagement grooves by, as an engagement means, clipping securely with a clipping means such as clips (18) the opposed bend surfaces (3) of first and the second meandering sections (11), (12) to each other. It may be also conducted as an engagement means that after disposing the curved straight pipe sections (2) in engagement grooves (8), straight pipe sections (2) are pressurized and thereby causes deformation of the pipes to be straight so as to fit into engagement grooves (8) tightly. By using such method, the outward deformative swelling of straight pipe sections (2) can be prevented and thus straight pipe sections (2) can be disposed in engagement grooves (8) straightly, resulting in establishing a good heat conductivity between straight pipe sections (2) and fin member (5).

In the above first embodiment, a single metal pipe is bent to form meandering pipe main body (1) composed of the plurality of straight pipe sections (2), bend portions (3), connection pipe (13) and others, whereas in the second embodiment, bend portions (3) and connection pipe (13) are formed of U-bent pipes and the plurality of straight pipe sections (2) are formed of mutually independent straight pipes. These plurality of straight pipes (2) are arranged spaced by opposing gaps, each straight pipe (2) is connected to the corresponding bend portion (3) to fasten each other by brazing or welding, thereby forming a pair of meandering sections (11), (12) separately. Then, the connection pipe connects the pair of meandering sections (11), (12) opposingly arranged with the insertion gap for fin member (5). For an easy placement of the pipes in engagement grooves (8), straight pipe sections (2) are formed in oval shapes in substantially the same manner as the first embodiment.

FIG. 7 illustrates an enlarged cross sectional view of the joint portion between straight pipe section (2) and bend portion (3) according to the second embodiment. The joint portion between straight pipe section (2) and connection pipe (13) are connected in an identical manner. In this second embodiment, as shown in FIG. 7, a top of the bend portion (3) or connection pipe (13) is inserted into straight pipe section (2) to tightly connect them together but a top of straight pipe section (2) may be formed as disposed in an insertable manner as a substitutable means to tightly connect straight pipe section (2) with connection pipe (12). Heat Exchanger (10) may be so formed that fin member (5) is placed in insertion gap (17) for fin member (5) formed between the first and the second meandering sections (11), (12) of thus formed meandering pipe main body (1) and each straight pipe section (2) is disposed in the corresponding engagement groove (8) provided on both end surfaces (6), (7) of this fin member (5), respectively, and then the opposing bend portions (3) of the first and the second meandering sections (11), (12) are clipped together by a clipping means such as clips (18).

However, in the case of this second embodiment, comparing to meandering pipe main body (1) formed of the single metal pipe as described in the first embodiment, extra works for brazing and welding are required and also the use of the U-bent pipe has been disclosed in conventional inventions such as taught by Japanese Patent Laying-Open No. 2003-88924. In this conventional art, straight pipes are inserted into throughholes of thin plate fins and thereafter connected by U-bent pipes by brazing or welding and the like, that means, careful operation is required so as not to cause breakage of a fin member and thus brazing or welding or the like processes are difficult to apply, and furthermore, leakage test of joint portion is not easy to run. In the present invention, however, before placing meandering pipe main body (1) on fin member (5), straight pipe sections (2) and bend portions (3) made of a U-bent pipe or connection pipe (13) can be connected together. Therefore, fin member (5) does not obstruct the connection operation, brazing and welding and the like processing can be applied with ease and the leakage test at the connecting portion can be run easily. Meandering pipe main body (1) is obtainable only by combining the conventional straight pipes and U-bent pipes and, upon compressing the straight pipes for the sake of disposing in engagement grooves (8), meandering pipe main body (1) can be formed prior to connecting with bend portions (3) and connection pipe (13), so that the required operations such as compressing process can be done with ease.

In the above first and second embodiments, straight pipe sections (2) are secured to engagement grooves (8) by clipping force of the first and the second meandering sections (11), (12) and clip-fastening force of clips (18). In order for straight pipe sections (2) to more tightly fit into engagement grooves (8), in the third embodiment as shown in FIG. 8, straight pipe sections (2) are formed in such oval shapes that the shorter diameter of the oval becomes smaller than the width of the corresponding engagement groove (8) and the longer diameter of the oval becomes larger than the width of the corresponding engagement groove (8) upon disposing straight pipe sections (2) in engagement grooves (8). In such a case that the oval straight pipe sections (2) are disposed in engagement grooves (8), as shown in FIG. 8, the longer diameter of the oval is oriented to the bottom-to-opening direction of the corresponding engagement groove (8). As the shorter diameter of the oval straight pipe section which is oriented to the width direction of the corresponding engagement groove (8) is smaller than the width of the corresponding engagement groove (8), straight pipe sections (2) can be disposed in engagement grooves (8) with ease without requiring a strong pressing force.

At the time of completion of disposing straight pipe sections (2) in engagement grooves (8), as shown in FIG. 8, there are spaces between the outer periphery of each straight pipe section (2) of the first and the second meandering sections (11), (12) and the inner periphery of the corresponding engagement groove (8), and therefore fin member (5) is secured only by clipping force generated by the first and the second meandering sections (11), (12), in the direction of insertion gap (17). Then, in the next process, as shown in FIG. 9, an interior of meandering pipe main body (1) is pressurized by an adequate means to expand the body, thereby allowing the outer periphery of each straight pipe section (2) to tightly fit within the inner periphery of the corresponding engagement groove (8) and allowing meandering pipe main body (1) to tightly fit with fin member (5), which results in increasing of the contact area between straight pipe section (2) and the corresponding engagement groove (8) to render an enhanced heat conductivity between straight pipe sections (2) and fin member (5). The fitting force between straight pipe sections (2) and engagement grooves (8) establishes a tight securing between meandering pipe main body (1) and fin member (5) without using a clipping means such as clips (18). Such structure contributes a reduction of the number of parts to be required; however, the use of clipping means such as clips (18) may be still available because which can establish more tight and stable connection between meandering pipe main body (1) and fin member (5).

Meanwhile, in the present embodiment as shown in FIGS. 8 and 9, rectangular shapes of engagement grooves (8) realize an easy formation thereof; however, if engagement grooves (8) are formed in oval shapes or oblong shapes in accordance with the appearances of straight pipe sections (2), the contact area therebetween can be increased to enhance further heat conductivity between straight pipe sections (2) and fin member (5). Also, straight pipe sections (2) may be formed in rectangular shapes in accordance with engagement grooves (8). In a case where straight pipe sections (2) are formed in the rectangular shapes, the shorter diameter of the oval is made smaller than the width of each engagement groove (8), the longer diameter of the oval is larger than the width of each engagement groove (8), straight pipe section (2) is disposed in the corresponding engagement groove (8) in a vertically long direction, and then straight pipe sections (2) are expanded to tightly fit into engagement grooves (8).

In such conventional art as taught in Japanese Patent Laying-Open No. 2003-88924 that a mandrel is employed as the expanding means, it is necessary to connect a U-bend pipe to the straight pipe after the straight pipe having been inserted into thin fins, is expanded. To the contrary, in the third embodiment of the present invention, meandering pipe main body (1) is inwardly pressurized to expand after disposing straight pipe sections (2) in engagement grooves (8), thereby fitting straight pipe sections (2) with engagement grooves (8) tightly. Therefore, brazing or welding or the like between pipes after the expansion thereof can be omitted, and thus the working efficiency can be improved and the brakeage of fin member (5) or other inadvertent damages are avoidable.

Straight pipe sections (2) are secured with engagement grooves (8), according to the first and second embodiments, by clipping means such as clips (18) and according to the third embodiment, by expansion of straight pipe sections (2). As the securing means between straight pipe sections (2) and the engagement groves (8) other than the above, the following is also available that the outer diameter of each straight pipe section (2) is made slightly larger than the width of the corresponding engagement groove (8) to have straight pipe section (2) having a larger outer diameter pressed as fitted within the corresponding engagement groove (8), so that the pipe expansion operation can be omitted. In such a case, clips (18), clamping members and other clipping members can be used to clip the opposing bend portions (3) of the first and the second meandering sections (11), (12), so that meandering pipe main body (1) and fin member (5) can be secured more tightly and stably.

In the above first and second embodiment, only straight pipe sections (2) of meandering pipe main body (1) is formed into compressed shapes having oval cross sections. In the fourth embodiment as shown in FIG. 10, straight pipe sections (2) and bend portions (3) are formed into compressed shapes having rectangular cross sections. Also, engagement grooves (8) of fin member (5) in which straight pipe sections (2) are disposed are formed in rectangular shapes in accordance with the outer peripheries of straight pipe sections (2). At the time of disposing straight pipe sections (2) in engagement grooves (8), the longer diameters of straight pipe sections (2) are oriented in the bottom-to-opening directions, the longer diameters are made larger than the widths of engagement grooves (8), the shorter diameters of straight pipe sections (2) oriented in the width directions of engagement grooves (8) is made smaller than the widths of engagement grooves (8), such that straight pipe sections (2) can be disposed in engagement grooves (8) with ease. Bend portions (3) are also formed in rectangular shapes alike straight pipe sections (2), thereby enabling an easy compressing of meandering pipe main body (1). Then, after completing to dispose straight pipe sections (2) in engagement grooves (8), as such is done in the third embodiment, meandering pipe main body (1) is inwardly pressurized to be expanded to have straight pipe sections (2) tightly fitted in engagement grooves (8). Joint pipe (15) and connection pipe (13) of meandering pipe main body (1) are not formed in oval but remained in circular in cross section.

As stated above, since straight pipe sections (2) of the rectangular shapes are fitted into engagement grooves (8) of the rectangular shapes, the contact area between straight pipe sections (2) and engagement grooves (8) is increased so that the heat conductivity therebetween can be improved. Heat exchanger (10) with such structure can also be manufactured easily and since bend portions (3) are formed in the rectangular shape, more stable clipping by clipping means such as clips (18) can be achieved comparing to a case where the circular or oval bend portions (3) are clipped.

In the above first and fourth embodiments, fin member (5) is composed of corrugate fins and thus a plurality of fins (4) are continuous. As a matter of course, a plurality of independent plate-like fins may be used to form fin member (5). An example of such structure is illustrated in FIG. 11 as the fifth embodiment, in which a plurality of plate-like fins (4) are arranged in parallel to construct fin member (5) and the opposed both end surfaces (6), (7) of fin member (5) are cut off for a plurality of portions in a convex shapes to form a plurality of engagement grooves (8) in parallel. After the compressed straight pipe sections (2) of the pair of meandering sections (11), (12) are disposed in engagement grooves (8) of both end surfaces (6), (7) following the manufacturing method identical to the first embodiment, straight pipe sections (2) are provided with expansion process or the like to establish tight fit between engagement grooves (8) and straight pipe sections (2).

In the conventional art as taught in Japanese Patent Laying-Open No. 2003-88924, the thin fins are arranged in parallel, whereas in the fifth embodiment of the present invention, both ends of fins (4) are cut off to preliminary form engagement grooves (8), the plurality of such fins are arranged in parallel to form fin member (5), and then straight pipe sections (2) are fitted in thus formed engagement grooves (8). Such construction, comparing to the conventional art in which throughholes are provided in fins to insert the pipe main body therein, is easy to process, avoidable of deformation or damage of fins (4) upon the disposing operation of straight pipe sections (2), and thus the working efficiency can be improved. Fin member (5) is clipped with the pair of the meandering sections (11), (12) so that stability of each fin (4) can be enhanced and better permanence of heat exchanger (10) is obtainable.

When heat exchanger (10) as described in the fifth embodiment is utilized as a fuel pipe, the heat exchanger is secured to an underfloor of the vehicles by the clamping members or the like, which are also to be used as clipping members for clipping the opposing bend portions (3) of the pair of the first and the second meandering sections (11), (12). As such, the number of parts to be used can be reduced and thus the working efficiency can be improved. This clipping member is composed of base plate (20) and bolts (21) of which head portions each has a larger diameter than that of each bend portion (3), wherein the bolts (21) are inserted into the corresponding opposed bend portion (3) and screwed into base plate (20), thereby clipping the opposing bend portions (3) and improving tightness in fitting meandering pipe main body (1) with fin member (5). Then, base plate (20) is secured on the floor using another bolts (22) to locate heat exchanger (10) at an underfloor. A pair of joint pipes (15) provided at both ends of meandering pipe main body (1) are clipped by clips (18) to establish a stable securing of joint pipes (15).

In the above first to fifth embodiments, to achieve efficient heat conductivity, heat exchanger (10) is located such that the flowing direction of the exterior fluid and positions of fins (4) are required to be in parallel to each other, i.e., in some cases the location direction may be limited. Accordingly, in FIG. 12 illustrating the sixth embodiment, each fin (4) is provided with a plurality of openings as flow channels (23) having rectangular shapes through which the exterior fluid can flow. By providing such fluid channels (23), the exterior fluid flows in a vertical direction with respect to the heat conductive surface of fins (4), thereby enabling heat exchange therebetween. Thus, independent from a flowing direction of the exterior fluid, heat exchanger (10) can be located in a free direction which renders layout better. Further, due to flow channels (23), the turbulence of the exterior fluid flowing the periphery of fins (4) may occur, so that better heat exchange ability may be obtained between fins (4) and the exterior fluid because of abruption of boundary layers.

Flow channels (23) may be arranged in parallel between adjacent fins (4) and also may be arranged in displaced positions between fins (4) in order to improve the turbulence of the exterior fluid. Also, the shapes of flow channels (23) may be formed in any shapes other than the rectangular shape. The shapes of flow channels (23) may include a circular shape, an oval shape, an oblong shape, a star shape, a gear shape, a triangle shape, a pentagon shape, a polygon shape or any other shapes. Further, the number of flow channels (23) may be one for each fin (4) and may be a plural for each fin (4). Namely, the shapes and the numbers of flow channels (23) may be freely decided.

In the above first to sixth embodiments, both end surfaces (6), (7) of each fin (4) are cut off in convex shapes to form engagement grooves (8), so that the contact area between fin member (5) and straight pipe sections (2) is an area corresponding only to the thickness of fin member (5). Therefore, in order to further improve the heat conductivity between fin member (5) and straight pipe sections (2), it is preferred to dispose a spacer or the like in each gap between engagement grooves (8) of each fin (4), thereby allowing the heat exchange between fin member (5) and straight pipe sections (2) through the spacers. However, the use of the spacers may invite increase of the number of parts to be used and the number of steps for attachment operation. In FIGS. 13 to 15 illustrating the seventh embodiment, partial fins (4) also serve as spacers.

In order for the partial fins (4) to serve as spacers, in the sixth embodiment, fins (4) are not cut off, but both end surfaces (6), (7) of fin member (5) are press-deformed in arc shapes to form engagement grooves (8). Associating the press-deformation, both end surfaces (6), (7) of fins (4) are squashed, thereby having both sides of each fin (4) projected to form swelling collars (24). Swelling collars (24) are positioned so as to be adjacent to or in contact with each other between the adjacent fins (4) and the entire heat exchanger (10) is so formed that gaps located on areas disposed with straight pipe sections (2) are reduced as narrow as possible or are eliminated. Swelling collars (24) are so formed that wide inner peripheral surfaces thereof are, as shown in FIGS. 14 and 15, brought into surface-contact with the outer peripheral surfaces of the straight pipe sections (2), thereby increasing the heat conductible area between fins (4) and straight pipe sections (2) to improve the heat conductivity therebetween without using independent spacers. Accordingly, the heat exchange ability of heat exchanger (10) can be further enhanced and the number of parts to be used and the number of steps for attachment operation can be reduced as well, resulting in manufacturing inexpensive products.

The above seventh embodiment exemplifies that both end surfaces (6), (7) of fins (4) of fin member (5) composed of corrugate fins are press-deformed. In fin member (5) in which a plurality of plate-like fins (4) are arranged in parallel such as exemplified in the fifth embodiment, it is also possible to press-deform both end surfaces of (6), (7) to form engagement grooves (8). In such case also, the plate-like fins are deformed in a planar manner to form swelling collars (24) which are brought into surface-contact with the outer peripheral surface of meandering pipe main body (1), and therefore, the heat conductive area therebetween increases to enhance the heat conductivity. Thus, heat exchanger (10) of an excellent heat exchange ability is obtainable.

In the above embodiments, fin member (5) is positioned within a range of insertion gap (17) between the first and the second meandering sections (11), (12). On the other hand, in FIGS. 16 and 17 illustrating the eighth embodiment, extra fin member (25) is positioned outside the first meandering section (11). The extra fin member (25) as well as fin member (5) positioned within insertion gap (17) is composed of corrugate fins and is provided with engagement grooves (8) in which a plurality of straight pipe sections (2) of the first meandering section (11) can be disposed; however, the height of fin member (25) is smaller than that of fin member (5) to be positioned between insertion gap (17) such that the entire body of heat exchanger (10) will not become too bulky.

After engagement grooves (8) of fin member (25) provided on the outside are formed as shown in FIG. 6(*b*) and outsides of straight pipe sections (2) of the first meandering section (11) are disposed therein, straight pipe sections are expanded to tightly fit into engagement grooves (8) to engage fin member (25) with the first meandering section (11). In order to establish better securing between fin member (25) located outside the first meandering section (11) and fin member (5) placed within insertion gap (17), and meandering main body (1), fin member (25) and bend portions (3) are clipped by clipping means. The clipping means is configured in such a manner shown in FIGS. 16 and 17, namely, metal made tightening belts (26) are provided on an upper surface of fin member (25) so as to be in parallel with straight pipe sections (2), and supporting plates (30) having a larger width than opposing gap (16) of straight pipe sections (2) forms a bridge between the adjacent straight pipe sections (2) for the purpose of clipping thereof.

Flanges (27) at both ends of tightening belts (26) are layered onto supporting plates (30), flanges (27) and supporting plates (30) are penetrated together by long bolts (21), and long bolts (21) are screwed into base plate (20) which is placed under surface of the second meandering section (12). As a result thereof, fin member (25) is secured tightly onto the first meandering section (11). The plurality of tightening belts (26), supporting plates (30) and the like are disposed between the adjacent straight pipe sections (2) respectively, so that the securing strength and the stability between fin members (5), (25) and meandering pipe main body (1) can be enhanced. Due to this clipping by the clipping means, fin member (25) is secured tightly onto meandering pipe main body (1) as well as the first and the second meandering sections (11), (12) and fin member (5) placed within insertion gap (17) are clipped tightly. As such, the heat exchange ability is improved. Securing of base plate (20) to an underfloor enables the stability of the heat exchanger (10).

As stated above, in the eighth embodiment, the heat conductible area of heat exchanger (10) increases owing to installation of fin member (25) outside the first meandering section (11). About the entirety of straight pipe sections (2) of the first meandering section (11) is covered by fin members (5), (25). Therefore, through fin member (5) within insertion gap (17) and each fin (4) of fin member (25) outside the first meandering section, heat of fuel flowing within straight pipe sections (2) can be transmitted efficiently to the exterior fluid, thereby further improving the cooling effect to the fuel. Owing to the arrangement of fin member (25), the first meandering section (11) is covered and thus protected, which improves impact-resistance with respect to scattering stones and therefore the possible damages or the like to meandering pipe main body (1) can be prevented. Upon arrangement of fin member (25) outside the first meandering section (11), the second end surface (7) of fine member (25) and the first end surface (6) of fin member (5) arranged on an inside of the first meandering section (11) do not contact each other and are formed in such a size that a slight gap resides therebetween as shown in FIG. 16. As a result, straight pipe sections (2) will not project out of engagement grooves (8) of fin members (25), (5) but can surface-contact assuredly each other by a wide area to maintain good heat conductivity between straight pipe sections (2) and fin members (25), (5).

In the eighth embodiment, supporting plates (30) are used. However, flanges (27) of tightening belts (26) may be formed in such a width wider than opposing gap (16) of straight pipe sections (2) and thus capable of being bridged with the adjacent flanges (27), thereby securing flanges (27) on base plate (21). Furthermore, the long tightening belt (26) extending to base plate (20) may be used to secure flanges (27) of the tightening belt (26) by bolts (21) upon layering flanges (27) on base plate (20). In the eighth embodiment, fin member (25) is arranged only at the outside of the first meandering section (11). However, if there is no obstacles in installing in vehicles or the like, fin member (25) can also be arranged outside the second meandering section (12), which contributes to further improvement of heat conductivity at a side of the second meandering section (12), thereby further enhancing the heat conductivity of heat exchanger (10)

In the eighth embodiment, tightening belts (26) are used. However, another embodiment not shown is hereinafter exemplified that the outermost fins (4) of fin member (25) composed of corrugated fins are folded back horizontally to form flange-like fins (4) which are placed on the upper surface of the plurality of straight pipe sections (2) of the first meandering section (11). Then, by securing this flange-like fins (4) on base plate (20) by means of a plurality of bolts (21), fin member (25) can be secured on the first meandering section (11) as well as the first meandering section (11) between fin member (25) and base plate (20) and the second meandering section (12) are urged so as to be closer to each other, thereby achieving tight clipping of fin member (5) arranged within insertion gap (17).

Use of fin member (25) as parts of the clipping members by utilizing the merit that the fins are of corrugated shapes requires neither tightening belts (26) nor supporting plates (30), thereby being capable of reducing the number of parts to be used to provide less expensive products. In this case also, if supporting plates (30) are placed between fins (4) serving also as the flanges and straight pipe sections (2) in order to strengthen fin member (5), more stable and tight clipping can be established between fin members (5), (25) and meandering pipe main body (1).

The ninth embodiment of the second invention according to the present invention is explained hereinafter. In the first to eighth embodiments according to the first invention, a gap between the first meandering section (11) and the second meandering section (12) serves as insertion gap (17) of fin member (5), whereas in the ninth embodiment according to the second invention as shown in FIG. 18, a plurality of gaps formed in tiers between the plurality of adjacent straight pipe sections (2) are insertion gaps (17) of fin member (5). To manufacture heat exchanger (10) according to the ninth embodiment, the first and the second meandering sections (11), (12), which have the plurality of straight pipe sections (2) and bend portions (3) and are connected by connection pipe (13), are disposed so as to opposed to each other through a desired opposing gap (16). Each fin member (5) placed on meandering pipe main body (1) is formed so as to have such a width that is larger than opposing gap (16) between the first and the second meandering sections (11), (12), in which each of both end surfaces (6), (7) is formed with two engagement grooves (8) spaced apart by the same distance as opposing gap (16).

Corresponding straight pipe sections (2) between the first and the second meandering sections (11), (12) are paired and each fin member (5) is inserted to be disposed within insertion gap (17) for fin member (5) formed in tiers between the plurality of pair of straight pipe sections (2). Each fin member (5) is inserted from insertion opening (28) formed at an opposite side of bend portions (3) between the adjacent straight pipe sections (2) as shown in FIG. 18, such that each fine member (5) is disposed the first and the second meandering sections (11), (12). One of the two pairs of adjacent straight pipe sections (2) are disposed in engagement grooves (8) of the first end surface (6) of fin member (5), the other pair of straight pipe sections (2) are disposed in engagement grooves (8) of the second end surface (7) and each pair of straight pipe sections (2) are disposed in and secured to the corresponding pair of engagement grooves (8) by any appropriate securing means, thereby forming heat exchanger (10).

This securing of straight pipe sections (2) to engagement grooves (8) can be done also by such a way that after each fin member (5) is inserted into corresponding insertion gap (17), the first and the second meandering sections (11), (12) are compressed to be deformed in a direction to narrow insertion gap (17), thereby clipping fin member (5) by the adjacent straight pipe sections (2), resulting in enhancing engagement strength and heat conductivity between fine member (5) and meandering pipe main body (1). Further, such ways are also available that straight pipe sections (2) compressed in the same manner as described in the third embodiment are disposed in engagement grooves (8) and thereafter straight pipe sections (2) are expanded to have them tightly fitted in engagement grooves (8); or diameters of straight pipe sections (2) are made slightly larger than widths of engagement grooves (8) and straight pipe sections (2) of larger diameters are press-fit into engagement grooves (8) to establish engagement therebetween. Although it is not shown in drawing, tightening belts (26) or the like bridge between the outside of the first meandering section (11) and the outside of the second meandering section (12) and tightening belts (26) thereafter are secured on base plate (20), thereby clipping meandering pipe main body (1) and fin member (5) together.

Because of the above-stated structure, heat exchanger (10) according to the ninth embodiment of the second invention is suitable to be installed to an underfloor or in a vertically long but horizontally narrow space in an apparatus or the like. Heat exchanger (10) having a compressed shape such like described in the first to eighth embodiments according to the first invention is suitable to be located in a space having low height such as an underfloor.

In the ninth embodiment, the uppermost and the lowermost straight pipe sections (2) each contacts corresponding fin member (5) only at an upper surface or a lower surface, whereas the other straight pipe sections (2) are sandwiched between fin members (5) and therefore almost entire outer peripheries of straight pipe sections (2) can contact fin members (5). Consequently, heat conductivity between meandering pipe main body (1) and fin members (5) can be enhanced and heat from the fuel flowing inside meandering pipe main body (1) can be transmitted effectively to the exterior fluid through straight pipe sections (2) and fin members (5). Each fin (4) of fin members (5) may be provided with flow channels (23) through which exterior fluid can flow, thereby causing turbulence of the exterior fluid capable of enhancing the heat exchange ability or rendering freedom for layout in installing heat exchanger (10) with respect to a wind direction.

In the tenth embodiment as illustrated in FIGS. 19 and 20, fin member (25) is arranged outside a pair of uppermost straight pipe sections (2), thereby realizing further improvement of the heat exchange ability of heat exchanger (10). In heat exchanger (10) according to the ninth embodiment alike that in the ninth embodiment, opposing straight pipe sections (2) of the first and the second meandering sections (11), (12) are paired and a plurality of spaces formed between the plurality of pair of adjacent straight pipe sections (2) in tires are insertion gaps (17) of fin members (5). Within the plurality of insertion gaps (17), each fin member (5) is placed to lie astride the first and the second meandering sections (11), (12) and straight pipe sections (2) are disposed in engagement grooves (8) of both end surfaces (6), (7) of each fin member (5). Further, as stated above, fin member (25) is arranged outside the pair of uppermost straight pipe sections (2) of the first and the second meandering sections (11), (12) and an outer surfaces of straight pipe sections (2) are disposed in engagement grooves (8) of fin member (25).

In the tenth embodiment, to enhance secureness between fin member (25) arranged outside the uppermost pair of straight pipes (2) and fin members (5) placed within insertion gaps (17) and meandering pipe main body (1), as shown in FIGS. 19 and 20, a belt-like tightening belt (26) made of metal bridges over the outside surface of fin member (25) in parallel with straight pipe sections (2). The belt-like tightening belt (26) bridges over both sides of the plurality of fin members (5) arranged in tiers and flanges (27) provided on both ends thereof are layered on base plate (20) placed at lower surface of heat exchanger (10) to fasten base plate (20) and flanges (27) through bolts (21). As such, straight pipe sections (2) are tightly engaged in engagement grooves (8), thereby capable of improving heat conductivity therebetween. Base plate (20) on which heat exchanger (10) is secured is secured to an underfloor of vehicles or the like through independent bolts (22).

Teat exchanger (10) having such a structure that almost entire outer periphery of straight pipe sections (2) contacts fin members (5), (25) can achieve better heat conductivity. Therefore, heat from fuel flowing within meandering pipe main body (1) can be transmitted effectively to fin members (5), (25) and subsequently discharged to the exterior fluid, so that the heat exchange ability of heat exchanger (10) improves. In this tenth embodiment also, such a way is available that both end surfaces (6), (7) of fin members (5), (25) are cut off in convex shapes to form engagement grooves (8). However, other way such that both end surfaces (6), (7) are press-deformed in shapes corresponding to appearances of straight pipe sections (2) to form engagement grooves (8) with swelling collars (24), thereby further increasing the heat conductive area between fin members (5), (25) and meandering pipe main body (1), resulting in improving heat conductivity therebetween.

In the above first to tenth embodiments, meandering pipe main body (1) is formed in a compressed shape such as oval, oblong and rectangular shapes or in a circular shape, and the inner and the outer surfaces of meandering pipe main body (1) are formed in plane smooth surfaces without irregularities. On the other hand, in FIG. 21 illustrating the eleventh embodiment, meandering pipe main body (1) is so formed as to concave inwardly to form a plurality of concave/convex portions (31) on inner and outer surfaces of meandering pipe main body (1). As stated above, formation of concave/convex shapes (31) causes turbulence of fluid flowing within meandering pipe main body (1) to peel off of a boundary layer near the inner and the outer surfaces of meandering pipe main body (1), thereby capable of improving the heat exchanging efficiency.

In the eleventh embodiment also, the entirety of meandering pipe main body (1) may be formed in a circular shape or a compressed shape such as an oval or a rectangular shape, and straight pipe sections (2) and/or bend portions (3) may be formed in compressed shapes while the other portions are formed in circular shapes. Convex/concave portions (31) may be formed around whole meandering pipe main body (1), or alternatively partially such as only on straight pipe sections (2). Further, shapes, size, forming intervals and the like of concave/convex portions (31) may be at constant or at random.

The twelfth embodiment describes heat exchanger (10) having a structure according to the first to eleventh embodiments in which after disposing straight pipe sections (2) of the first and the second meandering sections (11), (12) in engagement grooves (8) of fin member (5), molten resin material is filled and hardened at contacting portions between engagement grooves (8) and straight pipe sections (2) to bond them together. Owing to this bonding, a clipping member such as clip (18) and tightening belt (26) is not required to secure meandering pipe main body (1) to fin member (5), or simpler clipping members may be enough to be utilized herein.

In filling this resin material, for example as illustrated in FIGS. 6(*a*) and 9, molten resin material is filled in gaps between inner peripheries of engagement grooves (8) and outer peripheries of straight pipe sections (2). In a case where the gaps are small, entirety of each gap having heat insulating property is filled with the resin material and in a case where the gaps are relatively large, as shown in FIGS. 6(*a*) and 9 indicated by a chain double-dashed line, the molten resin material owing to its high viscosity adheres and hardens in a fillet shape to narrow each gap having heat insulating property by fillet (32). Therefore, heat conductivity can be improved through the resin material because a tight bonding can be established between straight pipe sections (2) and fin member (5), thereby being able to improve heat exchanging ability of heat exchanger (10). Further, fin member (5) and meandering pipe main body (1) can be bonded through the resin material to provide better securing and stability therebetween. As shown in FIGS. 6(*b*) and 14, even in a case where engaging grooves (8) and straight pipe sections (2) contact each other without gaps, at boundaries between engagement grooves (8) and straight pipe sections (2), molten resin material of high viscosity adheres and hardens to form fillets (32), thereby being capable of establishing bonding between meandering pipe main body (1) and fin member (5). Further, by increasing the contact area between straight pipe sections (2) and engagement grooves (8) as much as the surface area of resin-made fillets (32), heat conductivity can be enhanced therebetween.

The molten resin material may be a resin material for coating, a thermoplastic resin material, a thermosetting resin material, a photo-setting resin material, an ultraviolet curing resin or resin-made adhesives.

When the metal pipe of meandering pipe main body (1) is made of different metal from that of fin member (5), an electric erosion may occur due to potential difference therebetween. To avoid such possible electric erosion, in the thirteenth embodiment, the outer periphery of meandering pipe main body (1) to be used in heat exchanger (10) having structures described in the above first to eleventh embodiments is covered by a resin layer (not shown). This resin layer may be so formed that a resin material is pushed out onto the outer periphery of the metal pipe by using an extrusion molding apparatus, the resin material covers the outer periphery of the metal pipe by using a common apparatus such as a powder coating apparatus, a dipping coating apparatus and the like, and such a resin layer may be composed of one layer or a plurality of layers. A ready-made product on which the resin layer has already been covered may also be used, thereby saving time and effort to apply the resin layer, which results in producing less expensive product. The resin material to be used for this resin layer may be the thermoplastic resin material, the photo-setting resin material, the ultraviolet curing resin or the like.

Manufacturing step when using the thermoplastic resin material is exemplified hereinafter. The metal pipe covered by the resin layer is bent to form meandering pipe main body (1), with meandering pipe main body (1) securing with fin member (5) in such a manner as described in the first to eleventh embodiments, with the resin layer heating at melting temperature, with thereby the resin material being melted to achieve bonding between engagement grooves (8) and straight pipe sections (2) of the meandering pipe main body, and if there are gaps between straight pipe sections (2) and engagement grooves (8), a resin material is filled in the gaps having heat insulation property to fill up the gaps or fillets (32) is formed therein. Since meandering pipe main body (1) and fin members (5) are press-fit to each other, the fused resin material spreads over and fills the gaps. Then, the whole heat exchanger (10) is cooled to re-harden the resin material, thereby allowing meandering pipe main body (1) and fin members (5) to become substantially uniform through the resin layer, thus rendering better securing and better heat conductivity therebetween and thereby improving heat exchange ability of heat exchanger (10).

Since the preliminary application of the resin layer onto meandering pipe main body (1) provides corrosion resistance, it is not necessary to apply a corrosion resistance processing such as sacrificial protection type electroplating for corrosion prevention, chromate filming or the like, resulting in easy manufacturing process. Because of the use of meandering pipe main body (1) to which the resin layer has been applied, the metal pipes and fin members (5) will not contact directly, so that the electric corrosion due to the potential difference of the metals can be prevented effectively. Therefore, an iron-made metal pipe suitable for the use of alcohol containing fuel can be used for meandering pipe main body (1), an aluminium material of excellent heat discharging property can be used for fin members (5) without fearing the electric corrosion, and therefore heat exchanger (10) having an excellent corrosion resistance, fuel resistance and heat exchange ability is obtainable.

As the resin material to be used for the resin layer, the use of PA, PP, PE and the like results in producing heat exchanger (10) having good corrosion resistance and anti-shock property with low cost. Use of resin materials will contribute manufacturing of product having excellent heat exchange ability and corrosion resistance as well as heat resistance, such resin materials including monomer-cast nylon, polyamide-imide, polybenzimidazole, polyether ether keton, polyether-imide, polyether sulphone, polyimide, polyphenylen sulfide, polysulphone, polytetrafluoroethylene, tetrafluoroethylene-perfluoro alkoxyl alkane, fluoroethylene-propene, polychlorotrifluoro-ethylene, tetrafluoroethylene-ethylen, ethylene-chlorotrifuloroethylene and the like.

In the fourteenth embodiment as another different embodiment, in heat exchanger (10) having structures as described in the above first to eleventh embodiments, after engagement of meandering pipe main body (1) with fin members (5), the entire surface of thus engaged body may be applied to such coating processing as powder coating, electrostatic coating, dipping coating or the like. Further as described in the twelfth embodiment, the resin material may be filled at the contact area between straight pipe sections (2) and engagement grooves (8) to bond them together and thereafter the coating may be applied. Still further, as described in the thirteenth embodiment, after engaging meandering pipe main body (1) on which resin material is coated, with fin members (5), the coating may be applied.

The above stated covering process has an advantage, namely, cationic electro coating causes an electrostatic charge only for the metal material, thereby having coating compound adhered onto the metal material to coat over the outer surface and provide effective anti-corrosion. However, in such cases where filling members and adhesives made of the resin material are used as described in the twelfth embodiment and where the outer peripheral surface of meandering pipe body (1) is covered by the resin layer as described in the thirteenth embodiment, covering will not be applied to those resin materials and therefore the resin layer will not become thick and will not provide adverse effect to the heat conductivity.

In a case where the resin layer covers meandering pipe main body (1), upon cationic electro coating, resin layer is fused to thereby adhere to fin members (5) at the time of burning, so that the coating and the fuse-adhesion of the resin layer can be performed at the same time. Further, because boundaries of the fuse-adhered portions between fin embers (5) and resin layer can become uniform smoothly, the heat conductivity therebetween improves and engagement stability between fin members (5) and meandering pipe main body (1) is enhanced, and thus heat exchanger (10) having an excellent resistance against vibration is obtainable.

The resin material used in the twelfth embodiment, the resin layer used in the thirteenth embodiment and the resin material used as coating material in the fourteenth embodiment may contain metal materials such as copper, aluminium, stainless steel and the like, or particles or fibers formed of carbon material or glass material and so on, in order to enhance the heat conductivity of the resin materials. Use of black colored resin material having black body radiation effect is preferred, more specifically, the black colored resin material may contain the above stated particles and fibers, so that such resin material is obtainable as being excellent in the heat discharging property when discharging heat, and in heat absorbing property when absorbing heat.

Further, the above stated resin materials contain carbon nanofiber such as carbon nanotube, carbon nanohom or the like, thereby improving the heat conductivity of the resin material effectively and further improving the heat discharge property and the heat absorbing property of heat exchanger (10). It is preferred for such carbon nanofiber to be contained in the resin material by an amount more than 5 wt % and less than 30 wt %, which will render heat transmission effect better.

If the contained amount of carbon nanofiber is equal to or less than 5 wt %, the heat transmitting effect will become poor in improving heat transmitting effect. If the contained amount of carbon nanofiber is equal to or more than 30 wt %, the heat transmitting effect will not improve drastically and it is difficult for the resin material to contain more than 30 wt % carbon nanofiber which, however, may invite slow down of productivity and increasing of the product cost. The carbon nanofiber as mentioned herein represents the generic name of carbon nanotube, carbon nanohom and other nano-unit carbon fibers in the field of nanotechnology. The resin material may contain carbon nanotube, carbon nanohom and other nanofibers singularly, or in any combination thereof. In a case where carbon nanotube is contained in the resin material, the layer may be formed in a single layer with carbon nanotube or may be formed in a double-layer. Further, any aspect ratio is available with respect to carbon nanotube. Still further, any size, length and so on are available with regard to carbon nanotube.

In heat exchanger (10) according to the ninth and tenth embodiments, opposing gap (16) between the first and the second meandering sections (11), (12) are narrowed and fin members (5) formed in narrow width is placed therebetween, so that more compact heat exchanger is obtainable, thereby achieving space-saving and freedom in layout when installing. Opposing gap (16) is defined based on a curvature radius of connection pipe (13) which is bent in order to arrange the first and the second meandering sections (11), (12) in parallel. Opposing gap (16) can be narrower as the curvature radium is made smaller.

There is a limit to minimize the curvature radius when considering a relative relationship between a diameter of connection pipe (13) and bending stress of rollers or the like. Further, if connection pipe (13) is forcedly bent, breakage or crush may happen. Therefore, there is a limit in making opposing gap (16) narrow.

There is the following method which can resolve this problem. Connection pipe (13) is bent to be such a curvature that no crush and damage will happen, such that the first and the second meandering sections (11), (12) are arranged in parallel. Then, connection pipe (13) is twisted in a circumference direction with respect to axis directions of straight pipe sections (2), thereby achieving to narrow opposing gap (16) without crushing connection pipe (13). Further, both end surfaces (6), (7) of fin members (5) formed in narrow width are formed with engagement grooves (8) at a distance corresponding to opposing gap (16) and fin members (5) are inserted into insertion gap (17) between straight pipe sections (2) to obtain heat exchanger (10) of narrow and compact sized.

As stated above, only a twist of connection pipe (13) enables to narrow opposing gap (16). However, high technique is required in twisting connection pipe (13) in order to avoid displacement of a phase between the first and the second meandering sections (11), (12) as well as to maintain straight pipe sections (2) of the first and the second meandering sections (11), (12) in parallel. There may arise an adverse effect by an outward projection of the twisted connection pipe (13) to deteriorate the space-saving advantage of heat exchanger (10). Manufacturing process of heat exchanger (10) according to the fifteenth embodiment is explained referring to FIGS. 22 to 25, in which the aforementioned high technique is not required but simple manufacturing is achieved and space-saving is achieved as well.

In the fifteenth embodiment, the first meandering section (11) is formed in line symmetry with the second meandering section (12) and, as shown in FIG. 23, connection pipe (13) at one side of the straight pipe sections (2) is curved outwardly beyond a position of straight pipe sections (2) to form curving portion (33). When doing this process, with prospect of possible phase displacement between the first and the second meandering sections (11), (12) upon twisting connection pipe (13) in the future process, curving portion (33) is to be inclined in such a manner as shown in FIG. 23 and positions of straight pipe sections (2) of each of the first and the second meandering sections (11), (12) are to be displaced. Then, connection pipe (13) is bent so as to arrange the first and the second meandering sections (11), (12) to be opposed to each other as illustrated in FIG. 24. The formation of curving portion (33) and the bending process of connection pipe (13) can be performed at a large curvature radius which can avoid inconveniences such as crush of connection pipe (13) and so on.

Following the above process, connection pipe (13) is twisted in the circumference direction with respect to an axial direction, at which, however, curving portion (33) should be placed within insertion gap (17) for fin member (5). By this twisting, as shown in FIG. 25, straight pipe sections (2) of the first and the second meandering sections (11), (12) are arranged in parallel to each other, thereby narrowing opposing gap (16) and curving portion (33) is placed so as to be housed in insertion gap (17), thereby avoiding the outward projection of the curving portion (33).

In the fifteenth embodiment, both end surfaces (6), (7) at sides of bend surfaces (14) of fin members (5) formed in corrugated shapes are provided with engagement grooves (8) at distances corresponding to opposing gap (16). Fin members (5) are placed within insertion gaps (17) formed in tiers between straight pipe sections (2), thereby forming heat exchanger (10). Heat exchanger (10) thereby is clipped between metal-made brackets (35) and securing plates (36) serving as a clipping member. FIG. 22 illustrates a state that those brackets (35) and securing plates (36) are partially separated but secured and assembled to each other by welding, caulking, or the like while clipping meandering pipe main body (1) and fin members (5). Bolts (22) are inserted into brackets (35) and securing plates (36) to fix the assembly onto the counterpart member located to an underfloor, thereby completing installation of heat exchanger (10). For the sake of ventilation and lightweight, brackets (35) are provided with a plurality of circular windows (29) and securing plates (36) are provided with rectangular windows (29), respectively.

In such location of heat exchanger (10), wind coming parallel to opposing gap (16) between the first and the second meandering sections (11), (12) passes through fin members (5) and through a wide surface area of fin members (5), so that efficient heat exchange with fluid in meandering pipe main body (1) can be done. By narrowing opposing gap (16) between the first and the second meandering sections (11), (12), fin members (5) can be formed in narrow width. Therefore, thin compact heat exchanger (10) is obtainable which is good in space-saving and free in layout upon installation.

In the sixteenth embodiment as shown in FIG. 26, alike the above-stated fifteenth embodiment, connection pipe (13) between the first and the second meandering sections (11), (12) is twisted to narrow opposing gap (16) and fin members (5) are placed in insertion gap (17) formed between straight pipe sections (2) to assemble heat exchanger (10). Fin member (5) as used in this sixteenth embodiment is formed by bending a plate into a corrugated shape, in which engagement grooves (8) for receiving straight pipe sections (2) are provided to both end surfaces (6), (7) opposing to non-bend portion sides of fin members (5) of corrugated shapes.

Arrangement of the above stated fin members (5) enables wind to pass through fin members (5) in a direction parallel to insertion gap (17) of straight pipe sections (2), thereby enabling heat exchange. As such, heat exchanger (10) may be installed in a direction vertical to the wind direction as mentioned in the fifteenth embodiment. As described in the fifteenth and the sixteenth embodiments, fin members (5) are rotated in the circumference direction by 90 degrees with respect to the axis directions of straight pipe sections (2), thereby enabling heat exchanger (10) to be installed in a location in accordance with the wind direction. As a result thereof, heat exchanger (10) according to the present invention can make full use of the excellent heat exchanging ability.

In the above described fifteenth and sixteenth embodiments, fin members (5) are placed in insertion gap (17) formed between straight pipe sections (2) to narrow opposing gap (16) between the first and the second meandering sections (11), (12), thereby manufacturing heat exchanger (10) which is thin in the width direction of fin members (5). On the other hand, in the first to eighth embodiments in which the distance between the first and the second meandering sections (11), (12) serves as insertion gap (17) for receiving fin members (5), a thin heat exchanger (10) can be manufactured by narrowing insertion gap (17). To manufacture thin heat exchanger (10), alike the fifteenth and sixteenth embodiments, the first and the second meandering sections (11), (12) are arranged opposing to each other and then connection pipe (13) is twisted, so that insertion gap (17) between the first and the second meandering sections (11), (12) can be made into a width narrower than the smallest curvature radius upon bending straight pipe sections (2). Further, by forming a thickness in a height direction of fin members (5) to be placed in insertion gap (17) thin, a thin and compact heat exchanger (10) is obtainable.

In fin members (5) composed of plate-like fins or corrugated fins as described in the above embodiments, fins (4) each is formed in a plane shape, and therefore, for the sake of efficiently passing the external air through gaps between fins (4), a surface of each fin (4) should be arranged in parallel with respect to the wind direction, so that an installation direction of heat exchanger (10) is limited. To resolve this problem, in FIG. 27 illustrating the seventeenth embodiment, each end side of each fin (4) of a corrugated shape or a plate-like shape is bent to form an inclined surface (34). With such inclined surfaces (34), not only wind blowing in parallel to the surfaces of fins (4) but also wind blowing from an oblique direction can pass through fins (4), thereby achieving frequent contact between the external air and fin members (5) which results in an improvement of heat exchange ability. Such inclined surfaces (34) contributes to a stir of the external air, and a turbulence and a stir effect between surfaces of fins (4) and the exterior air occurs, so that the heat exchange can be enhanced due to a peeling of the boundary layers or the like. Further, it is not necessary to arrange fin members (5) strictly in accordance with the wind direction, and thus the installation direction of heat exchanger (10) is not limited. Therefore, freedom in layout is high.

In the sixth embodiments, rectangular flow channels (23) are provided in each fin (4) during the manufacturing step of fin members (5), whereas in the eighteenth embodiment as shown in FIG. 28, so-called punching plates (punching metals) preliminary provided with flow channels (23) are used to manufacture fin members (5), thereby saving time and effort to form flow channels (23). Also, in the eighteenth embodiment, punching plates preliminary provided with circular flow channels (23) are used; however, the shapes of such flow channels may be in any shape such as oval shape, oblong shape, star shape, gear shape, triangle shape, rectangular shape, cross shape, polygonal shape equal to or more than pentagonal shape, any other shapes, or combination of any of those shapes.

As described above, since edge portions increase by forming flow channels (23), the turbulence or the stir of the external air distributing between fins (4) are enhanced furthermore, and by the peeling of the boundary layers, the heat exchange effect between the interior and the exterior fluids through fin members (5) can be improved. Preferably, total punched area for flow channels (23) is 10 to 50% of a whole surface area of each fin (4). If the punched area for flow channels (23) is less than 10% of the whole surface area of each fin (4), the turbulence and the stir due to flow channels (23) will not occur sufficiently, whereas if it is more than 50%, the heat conductive area becomes smaller, and therefore the heat conductivity of fin members (5) decreases as well as each fin (4) becomes weak in strength or shakes due to wind pressure.

In the fifteenth to eighteenth embodiments, it is also possible to fill the molded resin material at contact portions between engagement grooves (8) and straight pipe sections (2) in order to bond them together, or it is further possible to place meandering pipe main body (1) covered by resin layer and fin members (5) together and then to fuse the resin layer in order to bond them together. Also, as shown in FIG. 21, meandering pipe main body (1) provided with convex/concave portions (31) may be used.

In the above described embodiments, heat exchanger (10) is exemplified as fuel pipe for vehicles. However, the heat exchanger (10) according to the present invention is also applicable to other fluid cooling pipe for vehicles and for construction equipments, air-conditions for adjusting temperature or humidity of living spaces, and other heat exchangers for the use of, e.g., absorption/discharge by various pipe arrangement, general industry, heaters, and hot water supply systems. In any of those cases, heat exchanger having excellent heat exchange ability and being inexpensive and compact in size is obtainable.

Use of such heat exchanger which is excellent in heat exchange performance, permanence and layout will enhance heat exchange ability and permanence of the fluid cooling pipes for vehicles and construction equipments, air conditions for adjusting temperature and humidity of the living spaces, absorption/discharge due to various pipe arrangement, an heat exchangers used in general industry, heaters, hot water supplying systems and others, as well as capable of achieving downsizing of the products.

What is claimed is:

1. A heat exchanger comprising:

a plurality of fin members composed of a plurality of fins arranged in parallel, the fins having both opposing end surfaces provided with a plurality of engagement grooves in parallel and at regular spaces; and a meandering pipe main body including:

a plurality of straight pipe sections to be disposed in the engagement grooves of the fin members, the plurality of straight pipe sections arranged in parallel and spaced by an insertion gap, a pair of meandering sections, each one of the pair of meandering sections comprising straight pipe sections among the plurality of straight pipe sections and a plurality of bend portions, wherein each bend portion of said plurality of bend portions joins straight pipe sections among the plurality of straight pipe sections, and wherein the pair of meandering sections are arranged so as to be opposed to each other through an opposing gap for fin members, and a connection pipe for connecting the one meandering section and the other meandering section across said opposing gap; and wherein the connection pipe between the one and the other meandering sections extends from one of the straight pipe sections of said one meandering section to one of the straight pipe sections of said other meandering section;

wherein the straight pipe sections of the one and the other meandering sections are arranged in parallel to each other;

wherein the opposing straight pipe sections of the one and the other meandering sections of the meandering pipe main section are paired, and wherein within the plurality of insertion gap for the fin members formed in a tiered manner between a plurality of pair of adjacent straight pipe sections, each fin member is placed so as to lie astride the one and the other meandering sections, and wherein the straight pipe sections of the one meandering section are disposed in the engagement grooves on one end surface of the fin members, and the straight pipe sections of the other meandering section are disposed in the engagement grooves on the other surface of the fin members in a secured manner;

wherein said one meandering pipe section occurs in a first plane having first and second orthogonal axes, said other meandering pipe section occurs in a second plane parallel to the first plane, the straight pipe sections extend in a direction parallel to said first orthogonal axis;

wherein said opposing gap separating said one and the other meandering sections extends relative to a third axis orthogonal to said first and second orthogonal axes; and wherein the connection pipe comprises a first bent portion, which extends from said one of the straight pipe sections of said one of the meandering sections, and a second bent portion, which extends from said one of the straight pipe sections of said other of the meandering sections;

wherein the first bent portion has a shape that is inclined relative to the first axis so as to extend at least relative to the first axis and the second axis;

wherein the second bent portion has a shape that is bent to extend along at least the third axis to narrow the distance between the one and the other meandering sections; and wherein said connection pipe as a whole has a shape twisting in a circumferential direction with regard to the axis directions of the straight pipe sections.

2. A heat exchanger comprising:

a meandering pipe main body having a first meandering section and a commonly-shaped, opposing second meandering section connected by a connection pipe section, wherein said first meandering section occurs in a first plane having first and second orthogonal axes and said second meandering section occurs in a second plane parallel to the first plane; and a plurality of fin members composed of a plurality of fins arranged in parallel, the fins having both opposing end surfaces provided with a plurality of engagement grooves in parallel and at regular spaces;

wherein each of the first and second meandering sections include a plurality of straight pipe sections to be disposed in the engagement grooves of the fin members, the plurality of straight pipe sections of the first meandering section arranged in parallel in said first plane, extending in parallel relative to said first orthogonal axis, and spaced relative to said second orthogonal axis by a first insertion gap for fin members, the plurality of straight pipe sections of the second meandering section arranged in parallel in said second plane, extending in parallel relative to said first orthogonal axis, and spaced relative to said second orthogonal axis by the first insertion gap for fin members, the first meandering section and second meandering section spaced apart relative to a third orthogonal axis by a second insertion gap for fin members;

wherein the connection pipe comprises a first bent portion, which extends from one of the straight pipe sections of said first meandering section, and a second bent portion, which extends from one of the straight pipe sections of said second meandering sections;

wherein the first bent portion has a shape that is inclined relative to the first orthogonal axis so as to extend at least relative to the first orthogonal axis and the second orthogonal axis;

wherein the second bent portion has a shape that is bent to extend along at least the third orthogonal axis to narrow the distance between the first and second meandering sections; and wherein said connection pipe as a whole has a shape twisting in a circumferential direction with regard to an axial direction of the straight pipe sections.

3. The heat exchanger of claim 1, wherein the fin member is provided to an outside of at least one of the straight pipe sections arranged at each end among the plural pairs of the straight pipe sections of the one and the other meandering sections, and wherein the outer surfaces of the straight pipe sections are disposed in and secured to the engagement grooves of this fin member.

4. The heat exchanger of claim 1 or 2, wherein the plurality of fin members comprise a plurality of plate fins arranged in parallel, and wherein engagement grooves are provided at opposing ends of each plate fin.

5. The heat exchanger of claim 1 or 2, wherein the plurality of fin members are formed by a plate that is bent into a corrugated shape to form a corrugated fin, and wherein the engagement grooves are provided at each opposing end surface at a bend surface side of the corrugated fin.

6. The heat exchanger of claim 1 or 2, wherein the plurality of fin members are formed by a plate that is bent into a corrugated shape to form a corrugated fin, and wherein the engagement grooves are provided at both opposing end surfaces at a non-bend surface side of the corrugated fin.

7. The heat exchanger of claim 1 or 2, wherein the engagement grooves are formed by cutting fin members in a convex shape.

8. The heat exchanger of claim 1 or 2, wherein the engagement grooves are formed by press-deforming the fin members into a convex shape.

9. The heat exchanger as claimed in claim 8, wherein the fin members are press-deformed into the convex shape such that collars projecting toward both sides of each fin associated with the press-deformation are near to or contact each other between the adjacent fins, and wherein the collars are brought in surface contact with an outer peripheral surface of the meandering pipe main body.

10. The heat exchanger of claim 1 or 2, wherein the straight pipe sections have a width larger than that of the engagement grooves.

11. The heat exchanger of claim 1, wherein the meandering pipe main body is so constructed that the straight pipe sections are formed in compressed shapes in cross section, and wherein a shorter diameter of each compressed shaped straight pipe sections is made smaller than the width of the engagement grooves, and wherein a longer diameter of each compressed shaped straight pipe sections is made larger than the width of the engagement grooves, and wherein after the compressed shaped straight pipe sections are disposed in the engagement grooves such that the longer diameter is oriented to a bottom-to-opening direction, the straight pipe sections are expanded to allow the outer peripheral surfaces thereof to be fit into the engagement grooves.

12. The heat exchanger of claim 3, wherein at least one of the fin members is securely clipped to at least one of the outsides of the one and the other meandering sections by clipping members.

13. The heat exchanger of claim 1 or 2, wherein the meandering pipe main section and the plurality of fin members, after disposing the straight pipe sections in the engagement grooves, are filled with molten resin material at a mutual contact portion to bond each other.

14. The heat exchanger of claim 1 or 2, wherein the outer peripheral surface of the meandering pipe main body is covered by a resin layer.

15. The heat exchanger as claimed in claim 14, wherein the resin layer applied to the outer peripheral surface of the meandering pipe main body is made of a thermoplastic resin material to be fused upon heating after the straight pipe section are disposed in the engagement grooves in order for the resin layer to be adhered to the engagement grooves of the fin member.

16. The heat exchanger of claim 1 or 2, wherein the meandering pipe main body and the plurality of fin members, after the straight pipe sections are disposed in the engagement grooves, have an outer surface thereof subject to a coating process.

17. The heat exchanger of claim 1 or 2, wherein end portion sides of each fin are bent to form inclined surfaces.

18. The heat exchanger of claim 1 or 2, wherein each fin is provided with a plurality of flow channels.

19. The heat exchanger as claimed in claim 11, wherein opposing bend portions of at least one of the plurality of fins and at least one of the meandering sections are securely clipped by clipping members.

20. The heat exchanger of claim 1, wherein the meandering pipe main body has a first end, and wherein the connection pipe occurs at a vicinity of said first end without extending to an opposite end.

21. The heat exchanger of claim 2, wherein the meandering pipe main body has a first end, and wherein the connection pipe occurs at a vicinity of said first end without extending to an opposite end.

* * * * *